US008014702B2

(12) United States Patent
Chiba

(10) Patent No.: US 8,014,702 B2
(45) Date of Patent: Sep. 6, 2011

(54) LIQUID DEVELOPER COLLECTION APPARATUS AND IMAGE FORMING APPARATUS

(75) Inventor: Satoshi Chiba, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 395 days.

(21) Appl. No.: 12/245,533

(22) Filed: Oct. 3, 2008

(65) Prior Publication Data

US 2009/0103949 A1 Apr. 23, 2009

(30) Foreign Application Priority Data

Oct. 17, 2007 (JP) ..... 2007-269765
Jun. 4, 2008 (JP) ..... 2008-146633

(51) Int. Cl.
*G03G 15/10* (2006.01)

(52) U.S. Cl. ..... 399/249; 399/237; 430/117.31; 101/426.1

(58) Field of Classification Search ..... 399/237, 399/249; 430/117.3, 117.31, 117.32; 101/416.1, 101/425
See application file for complete search history.

(56) References Cited

U.S. PATENT DOCUMENTS

| | | | | |
|---|---|---|---|---|
| 3,859,691 | A * | 1/1975 | Katayama et al. | 15/256.51 |
| 4,042,415 | A * | 8/1977 | Hwa | 134/6 |
| 6,829,460 | B2 * | 12/2004 | Kurotori et al. | 399/237 |
| 7,885,565 | B2 * | 2/2011 | Sasaki et al. | 399/57 |
| 2004/0047656 | A1 * | 3/2004 | Sakai et al. | 399/249 |
| 2005/0078984 | A1 * | 4/2005 | Fujita et al. | 399/249 |
| 2009/0035022 | A1 * | 2/2009 | Aruga et al. | 399/249 |
| 2009/0185843 | A1 * | 7/2009 | Chiba et al. | 399/348 |
| 2009/0196657 | A1 * | 8/2009 | Okumura et al. | 399/237 |
| 2009/0220283 | A1 * | 9/2009 | Nishiyama et al. | 399/239 |
| 2009/0232533 | A1 * | 9/2009 | Toyama et al. | 399/55 |
| 2009/0233214 | A1 * | 9/2009 | Hiraga et al. | 430/114 |
| 2009/0245833 | A1 * | 10/2009 | Sasaki et al. | 399/60 |
| 2010/0067950 | A1 * | 3/2010 | Toyama et al. | 399/159 |
| 2010/0080595 | A1 * | 4/2010 | Sasaki et al. | 399/57 |
| 2010/0135703 | A1 * | 6/2010 | Nakamura et al. | 399/313 |
| 2010/0260512 | A1 * | 10/2010 | Imamura et al. | 399/66 |
| 2010/0266318 | A1 * | 10/2010 | Kamijo et al. | 399/316 |
| 2010/0303516 | A1 * | 12/2010 | Chiba et al. | 399/304 |
| 2011/0044731 | A1 * | 2/2011 | Nomura et al. | 399/302 |
| 2011/0058830 | A1 * | 3/2011 | Saka et al. | 399/45 |
| 2011/0081172 | A1 * | 4/2011 | Imamura et al. | 399/304 |
| 2011/0097120 | A1 * | 4/2011 | Nomura | 399/304 |
| 2011/0103814 | A1 * | 5/2011 | Toyama et al. | 399/49 |
| 2011/0128594 | A1 * | 6/2011 | Sowa et al. | 358/475 |

FOREIGN PATENT DOCUMENTS

| | | |
|---|---|---|
| JP | 2001-228717 | 8/2001 |
| JP | 2002-287518 | 10/2002 |
| JP | 2006-030501 | 2/2006 |

* cited by examiner

*Primary Examiner* — David Gray
*Assistant Examiner* — G. M. Hyder
(74) *Attorney, Agent, or Firm* — DLA Piper LLP (US)

(57) ABSTRACT

A liquid developer collection apparatus and an image forming apparatus can prevent image disturbances and also disturbances of the toner particles on the image section that can be produced by squeezing. The liquid developer collection apparatus includes a first squeezing section 113*a*Y that squeeze a liquid developer on an image carrier carrying an image developed by the liquid developer containing carrier liquid and toner particles, and a second squeezing section 113*b*Y arranged vertically above the first squeezing section 113*a*Y to squeeze the image carrier squeezed by the first squeezing section 113*a*Y, and the liquid developer collected by the second squeezing section 113*b*Y is made to fall free onto the first squeezing section 113*a*Y and collected.

15 Claims, 14 Drawing Sheets

LIQUID DEVELOPER COLLECTION APPARATUS AND IMAGE FORMING APPARATUS

CROSS-REFERENCE TO RELATED APPLICATIONS

This application is based upon and claims the benefit of priority from prior Japanese Patent Applications No. 2007-269765 filed on Oct. 17, 2007 and No. 2008-146633 filed Jun. 4, 2008, the entire contents of which are incorporated herein by reference.

BACKGROUND OF THE INVENTION

1. Field of the Invention

This invention relates to a liquid developer collection apparatus for liquid developers using liquid toner where toner is dispersed in carrier liquid and also to an image forming apparatus adapted to use such liquid developers and such a liquid developer collection apparatus.

2. Description of the Related Art

A method of arranging a squeezing roller between a development nip and a transfer nip section, applying a bias close to the surface potential of a toner layer after a development process so as not to peel off toner from the toner layer and removing the residual toner floating on a non-image area after the development process is disclosed (see Patent Document 1: JP-2001-228717A).

A method of applying a removal voltage without any leak by selecting a volume resistance not higher than $10^9\Omega$ for a squeezing roller is also disclosed (see Patent Document 2: JP-2002-287518A).

Additionally, a method of preventing the performance of secondary transfer relative to paper from being degraded as the solid concentration in a liquid developer is raised by squeezing to lower the electric chargeability of lower is also disclosed (see Patent Document 3: JP-2006-30501A).

However, with any of the methods described in the above cited patent documents, toner particles on the image area are lopsidedly drawn to the surface of the corresponding photosensitive member by squeezing and toner particles on the non-image area are forced to float nearer to the surface layer of the toner layer on the photosensitive member than the toner particles on the image area. Additionally, the quantity of carrier on the photosensitive member that is to be removed needs to be limited in order to prevent the electric chargeability of toner particles from being damaged on the photosensitive member as a result of squeezing.

SUMMARY OF THE INVENTION

In view of the above-identified problems, it is therefore the object of the present invention to provide a liquid developer collection apparatus and an image forming apparatus that can prevent images from being disturbed and also prevent toner particles on the image area from being disturbed as a result of squeezing.

In an aspect of the present invention, the above object is achieved by providing a liquid developer collection apparatus including: a first squeezing section that squeeze a liquid developer on an image carrier carrying an image developed by the liquid developer containing carrier liquid and toner particles; and a second squeezing section arranged vertically above the first squeezing section to squeeze the image carrier squeezed by the first squeezing section. The liquid developer collected by the second squeezing section is made to fall free onto the first squeezing section and collected. Thus, the fluidity of the liquid developer collected by the first squeezing section is raised to improve the collection efficiency.

Preferably, the first squeezing section includes a first image carrier squeezing roller and a first cleaning blade held in contact with the first image carrier squeezing roller. The second squeezing section includes a second image carrier squeezing roller and a second cleaning blade held in contact with the second image carrier squeezing roller. With this arrangement, the ability of collecting the liquid developer is improved.

Preferably, the liquid developer collected by the second image carrier squeezing roller is scraped off by the second cleaning blade and subsequently the liquid developer scraped off by the second cleaning blade is made to fall free onto the first cleaning blade. Thus, the fluidity of the liquid developer collected by the first cleaning blade is raised to improve the collection efficiency.

Preferably, the first squeezing section includes a first blade support member supporting the first cleaning blade. The second squeezing section includes a second blade support member supporting the second cleaning blade. The liquid developer scraped off by the second cleaning blade is made to fall free from the second blade support member onto the first blade support member. With this arrangement, both the fluidity of the liquid developer collected by the first cleaning blade and that of the liquid developer collected by the second squeezing section are raised to improve the collection efficiency.

Preferably, the liquid developer collected by the second image carrier squeezing roller is made to fall free from the second cleaning blade onto the first image carrier squeezing roller. Thus, the fluidity of the liquid developer collected by the first image carrier squeezing roller is raised to improve the collection efficiency.

Preferably, the liquid developer that falls free from the second cleaning blade onto the first image carrier squeezing roller is made to fall free to the side of the first cleaning blade relative to the virtual vertical line passing through the axis of rotation of the first image carrier squeezing roller. With this arrangement, the falling liquid developer can move downward by free fall even when the first image carrier squeezing roller is held at rest and hence not rotating so as to fall further below by way of the first cleaning blade and the first blade support member.

Preferably, a length of the first cleaning blade in the axial direction of the first image carrier squeezing roller is greater than a length of the second cleaning blade in the axial direction of the second image carrier squeezing roller. Thus, the liquid developer collected by the second cleaning blade falls within the width of the first image carrier squeezing roller or that of the first cleaning blade in the axial direction of the image carrier when the liquid developer falls from the second cleaning blade.

Preferably, the first cleaning blade has gathering means that gather the liquid developer collected by the first image carrier squeezing roller toward the center side of the first image carrier squeezing roller relative to the direction of the axis of rotation thereof. With this arrangement, as the liquid developer that is collected by the second cleaning blade falls from the second cleaning blade, it is collected within the width of the first cleaning blade relative to the direction of the axis of the image carrier and the non-image area is not required to be wide.

Preferably, the liquid developer collection apparatus according to the present invention further includes a third squeezing section arranged vertically above the second squeezing section to squeeze the image squeezed by the second squeezing section and the liquid developer collected by the third squeezing section is made to fall free onto the second squeezing section. Thus, the fluidity of the liquid developer collected by the second squeezing section is raised to improve the collection efficiency.

Preferably, the third squeezing section includes a third image carrier squeezing roller and a third cleaning blade held in contact with the third image carrier squeezing roller. With this arrangement, the ability of collecting the liquid developer is improved.

Preferably, the liquid developer collected by the third image carrier squeezing roller is scraped off by the second cleaning blade and subsequently is made to fall free onto the second cleaning blade. Thus, the fluidity of the liquid developer collected by the second cleaning blade is raised to improve the collection efficiency.

Preferably, the third cleaning blade includes a third blade support member supporting the third cleaning blade and the liquid developer scraped off by the third cleaning blade is made to fall free from the third blade support member onto the second blade support member. With this arrangement, both the fluidity of the liquid developer collected by the second cleaning blade and that of the liquid developer collected by the third squeezing section are raised to improve the collection efficiency.

Preferably, the liquid developer collected by the third image carrier squeezing roller is made to fall free from the third cleaning blade onto the second image carrier squeezing roller. Thus, the fluidity of the liquid developer collected by the second image carrier squeezing roller is raised to improve the collection efficiency.

Preferably, the liquid developer that falls free from the third cleaning blade onto the second image carrier squeezing roller is made to fall free to the side of the second cleaning blade relative to the virtual vertical plane passing through the axis of rotation of the second image carrier squeezing roller. With this arrangement, the falling liquid developer can move downward by free fall even when the second image carrier squeezing roller is held at rest and hence not rotating so as to fall further below by way of the second cleaning blade and the second blade support member.

In another aspect of the present invention, there is provided an image forming apparatus including: a developer carrier that carry a liquid developer containing carrier liquid and toner particles; an image carrier carrying the image developed by the developer carrier; a transfer member that receives the image on the image carrier being transferred onto the transfer member; a first squeezing section that squeeze the liquid developer on an image carrier carrying an image developed by the developer carrier; a second squeezing section arranged vertically above the first squeezing section to squeeze the image carrier squeezed by the first squeezing section. The liquid developer collected by the second squeezing section is made to fall free onto the first squeezing section and collected. Thus, an image can be formed by means of a liquid developer showing a stabilized concentration. Hence, an image can be formed with an excellent image quality.

Still other objects and advantages of the invention will in part be obvious and will in part be apparent from the specification.

The invention accordingly includes the features of construction, combinations of elements, and arrangement of parts which will be exemplified in the construction hereinafter set forth, and the scope of the invention will be indicated in the claims.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
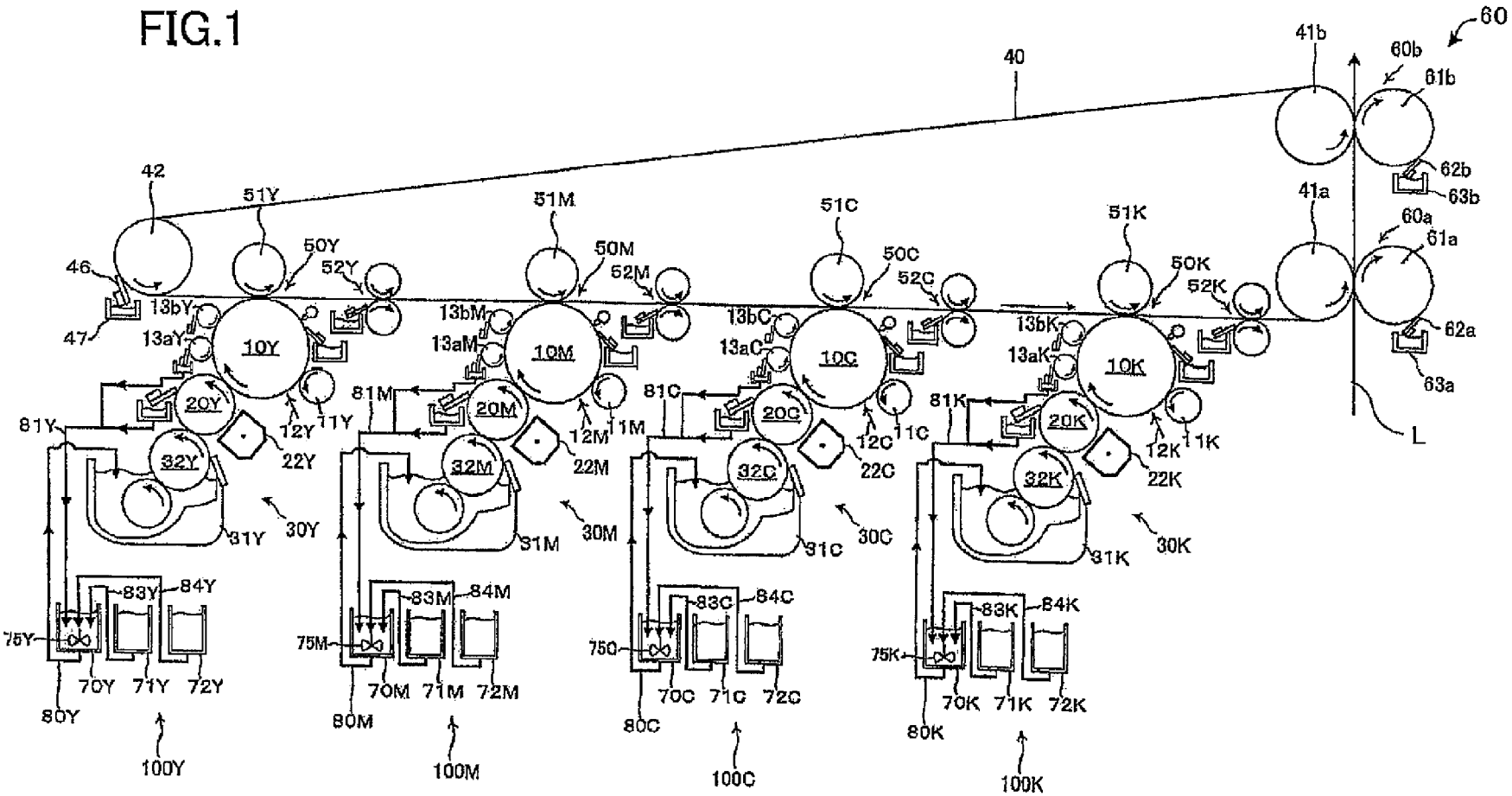
FIG. 1 is a schematic illustration of image forming apparatus according to a first embodiment of the present invention.

Now, the present invention will be described in greater detail by referring to the accompanying drawings that schematically illustrate preferred embodiments of the invention. FIG. 1 is a schematic illustration of image forming apparatus according to a first embodiment of the present invention, showing principal components thereof. The image forming apparatus of this embodiment has image forming sections of different colors that are arranged at a middle part of the apparatus. Development units 30Y, 30M, 30C and 30K and developer collection/supply units 100Y, 100M, 100C and 100K are arranged in a lower part of the image forming apparatus and intermediate transfer member 40 and secondary transfer section 60 are arranged in an upper part of the apparatus.

The image forming sections are formed respectively by image carriers 10Y, 10M, 10C and 10K each made of a photosensitive drum, chargers 11Y, 11M, 11C and 11K and exposure units 12Y, 12M, 12C and 12K. The exposure units 12Y, 12M 12C and 12K by turn have respective line heads formed by arranging LEDs. The image carriers 10Y, 10M, 10C and 10K are uniformly electrically charged by the respective chargers 11Y, 11M, 11C and 11K and exposed to respective beams of light that are modulated respectively by input video signals by means of the exposure units 12Y, 12M, 12C and 12K to form electrostatic latent images on the electrically charged image carriers 10Y, 10M, 10C and 10K.

The development units 30Y, 30M, 30C and 30K respectively have development rollers 20Y, 20M, 20C and 20K, developer containers 31Y, 31M, 31C and 31K storing liquid developers of different colors of yellow (Y), magenta (M), cyan (C) and black (K), developer supply rollers 32Y, 32M, 32C and 32K for supplying the liquid developers of these colors from the developer containers 31Y, 31M, 31C and 31K to the development rollers 20Y, 20M, 20C and 20K and so on and develop the electrostatic latent images formed on the image carriers 10Y, 10M, 10C and 10K by means of the liquid developers of the different colors.

The development units of this embodiment are structurally respectively held in contact with first image carrier squeezing rollers 13*a*Y, 13*a*M, 13*a*C and 13*a*K that operate as first carrier liquid removal means for exerting a squeezing effect and second image carrier squeezing rollers 13*b*Y, 13*b*M, 13*b*C and 13*b*K that operate as second carrier liquid removal means, whereas the development rollers 20Y, 20M, 20C and 20K are provided with respective toner compaction units 22Y, 22M, 22C and 22K for exerting a compaction effect on the development rollers.

Now, the developer collection/supply units 100Y, 100M, 100C and 100K will be described below.

Agitation tanks 70Y, 70M, 70C and 70K operate as liquid developer concentration adjustment devices and are adapted to be supplied respectively with high concentration toners from high concentration toner tanks 71Y, 71M, 71C and 71K by way of toner supply channels 83Y, 83M, 83C and 83K and with carrier oils from carrier oil tanks 72Y, 72M, 72C and 72K by way of carrier supply channels 84Y, 84M, 84C and 84K.

The agitation tanks 70Y, 70M, 70C and 70K receive the collected liquid developers respectively from the first image carrier squeezing rollers 13*a*Y, 13*a*M, 13*a*C and 13*a*K, the second image carrier squeezing rollers 13*b*Y, 13*b*M, 13*b*C and 13*b*K and the development rollers 20Y, 20M, 20C and 20K by way of first developer collection channels 81Y, 81M, 81C and 81K for recycle. Note that the collection channels including the first developer collection channels 81Y, 81M, 81C and 81K and the supply channels including toner supply channels 83Y, 83M, 83C and 83K and carrier supply channels 84Y, 84M, 84C and 84K, which will be described hereinafter are equipped with forcible liquid drive means such as pumps (not shown), if necessary.

The agitation tanks 70Y, 70M, 70C and 70K are provided with respective transmission type photosensors for detecting the dispersion weight ratios of toners (not shown) as means for detecting and controlling the concentrations of developers. Additionally, the agitation tanks 70Y, 70M, 70C and 70K are also provided with respective agitation devices 75Y, 75M, 75C and 75K typically including fins to agitate the high connection toners and the high concentration carrier oils supplied to them and the recycled liquid developers. The photosensors for detecting the concentrations of the developers may be replaced respectively by torque detection means for detecting the agitation torques of the agitation devices including fins so as to detect the concentrations by way of the detected torques.

The liquid developers agitated and adjusted in the agitation tanks 70Y, 70M, 70C and 70K are then supplied respectively to the developer containers (reservoirs) 31Y, 31M, 31C and 31K by way of developer supply channels 80Y, 80M, 80C and 80K.

The concentrations of the liquid developers in the agitation tanks 70Y, 70M, 70C and 70K can be controlled typically by predicting the quantities by which the liquid developers are consumed by counting the number of dots of the image to be output by a controller (not shown) for managing video signals, then predicting the concentrations of the developers in the developer containers (reservoirs) 31Y, 31M, 31C and 31K and predicting and controlling the quantities of high concentration toners to be supplied from the high concentration toner tanks 71Y, 71M, 71C and 71K and the quantities of carrier oils to be supplied from the carrier oil tanks 72Y, 72M, 72C and 72K to the agitation tanks 70Y, 70M, 70C and 70K. The control responsiveness and the reliability of the image forming apparatus can be improved by such an arrangement for prediction and control.

The intermediate transfer member 40 is an endless belt member that is wound around a first drive roller 41*a*, a second drive roller 41*b* and a tension roller 42. It is driven to rotate by the drive roller 41, while it is held in contact with the image carriers 10Y, 10M, 10C and 10K respectively at the primary transfer sections 50Y, 50M, 50C and 50K. In the primary transfer sections 50Y, 50M, 50C and 50K, the image carriers 10Y, 10M, 10C and 10K are respectively arranged vis-a-vis primary transfer rollers 51Y, 51M, 51C and 51K with the intermediate member 40 interposed between them. The toner images of the different colors on the image carriers 10Y, 10M, 10C and 10K are sequentially transferred onto the intermediate transfer member 40 one on the other at the respective transfer positions that are the contact positions of the intermediate transfer member 40 and the image carriers 10Y, 10M, 10C and 10K so as to form a full color toner image.

The secondary transfer unit 60 includes a first secondary transfer unit 60*a* and a second secondary transfer unit 60*b*. A first secondary transfer roller 61*a* and a second secondary transfer roller 61*b* are arranged vis-a-vis the first drive roller 41*a* and the second drive roller 41*b* with the intermediate transfer member 40 interposed between them. A first secondary transfer roller cleaning unit that includes a first secondary transfer roller cleaning blade 62*a* and a first developer collection section 63*a* and a second cleaning unit that includes a second secondary transfer roller cleaning blade 62*b* and a second developer collection section 63*b* are also arranged. In the secondary transfer unit 60, a sheet member typically made of paper, film or cloth is conveyed and supplied along a sheet member conveyance route L at the timing when the full color toner image formed on the intermediate transfer member 40 by laying toner images of different colors one on the other or the single color toner image formed on the intermediate transfer member 40 gets to the transfer position of the secondary transfer unit 60 so that the single color toner image or the full color toner image is transferred on the sheet member for a secondary transfer.

A fixing unit (not shown) is arranged along the sheet member conveyance route L and the single color toner image or the full color toner image transferred onto the sheet member is made to adhere to the recording medium (sheet member) by fusion and fixed to finally complete the process of forming an image on the sheet member.

A cleaning unit including an intermediate transfer member cleaning blade 46 and a developer collection section 47 is arranged along the outer periphery of the tension roller 42 around which the intermediate transfer member 40 is wound, the intermediate transfer member 40 being also would around the belt drive roller 41. After passing the secondary transfer unit 60, the intermediate transfer member 40 proceeds to the winding part of the tension roller 42. The surface of the intermediate transfer member 40 is cleaned by the interface transfer member cleaning blade 46 at the winding part of the tension roller 42 before the intermediate transfer member 40 proceeds to the primary transfer sections 50 once again.

Figure 2:
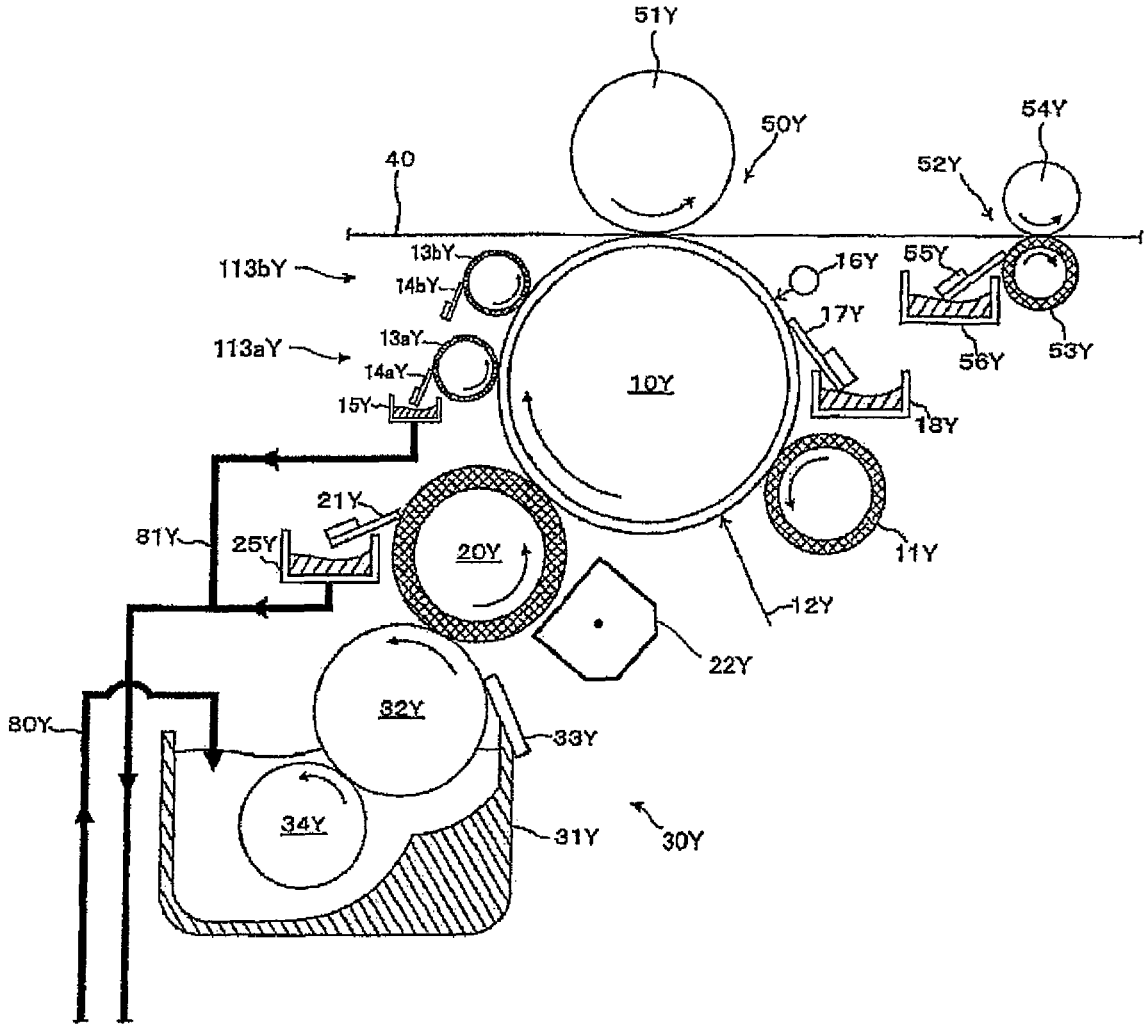
FIG. 2 is a schematic cross-sectional view of an image forming section and a development unit of the first example of the first embodiment, showing principal components thereof.
Figure 3:
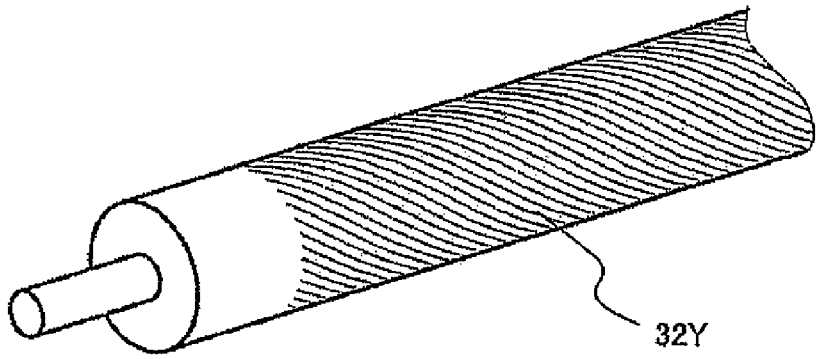
FIG. 3 is a schematic perspective view of a developer supply member of the first embodiment.
Figure 4:
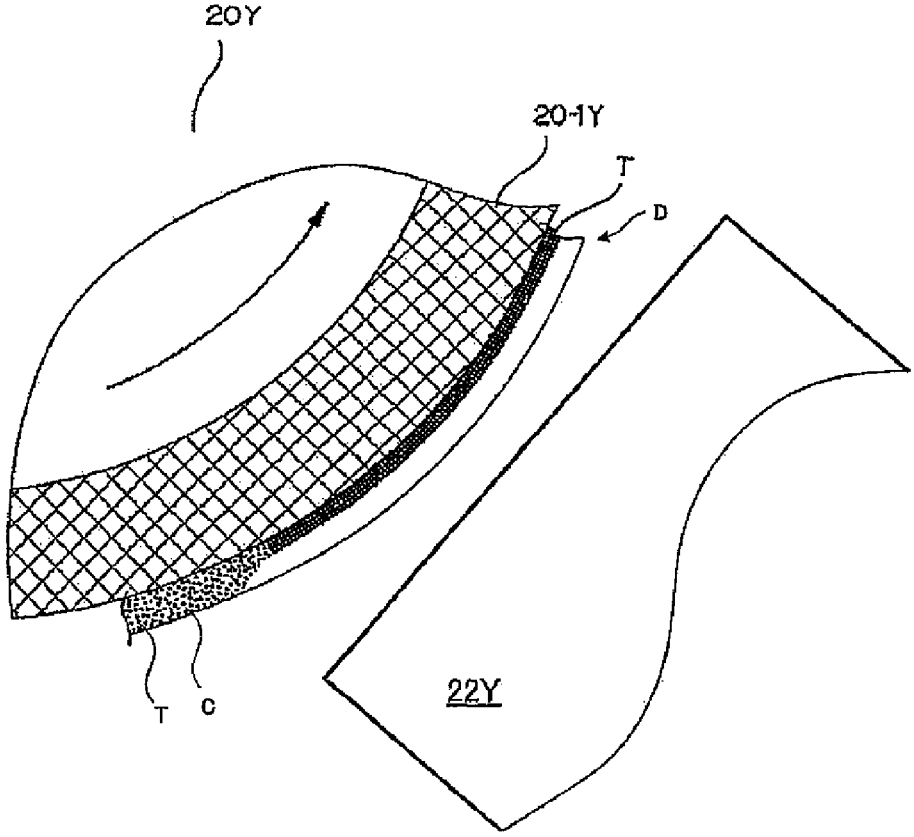
FIG. 4 is a schematic illustration of compaction of developer by developer compaction unit 22Y of the first example.
Figure 5:
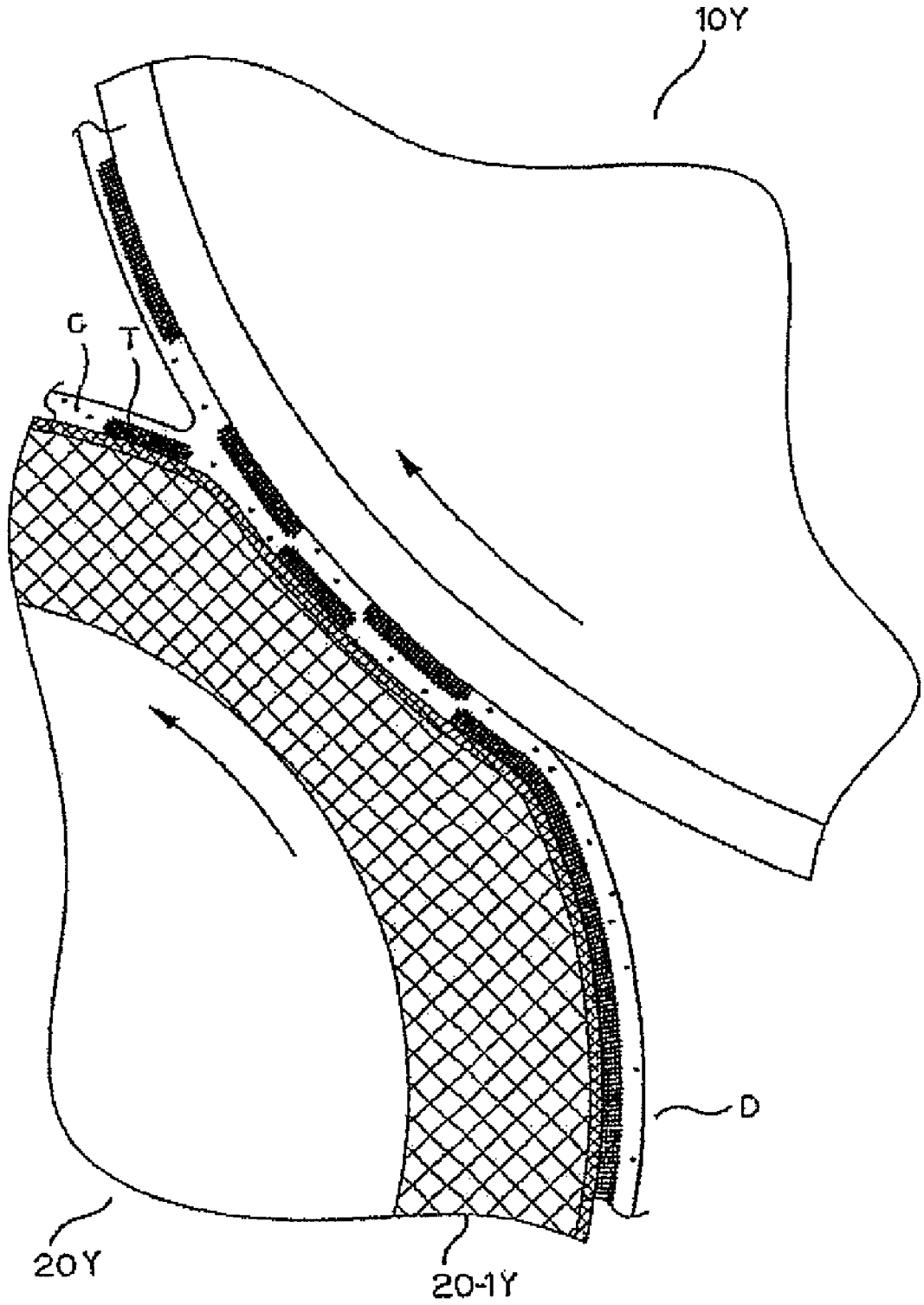
FIG. 5 is a schematic illustration of development by development roller 20Y of the first exemplar arrangement.
Figure 6:
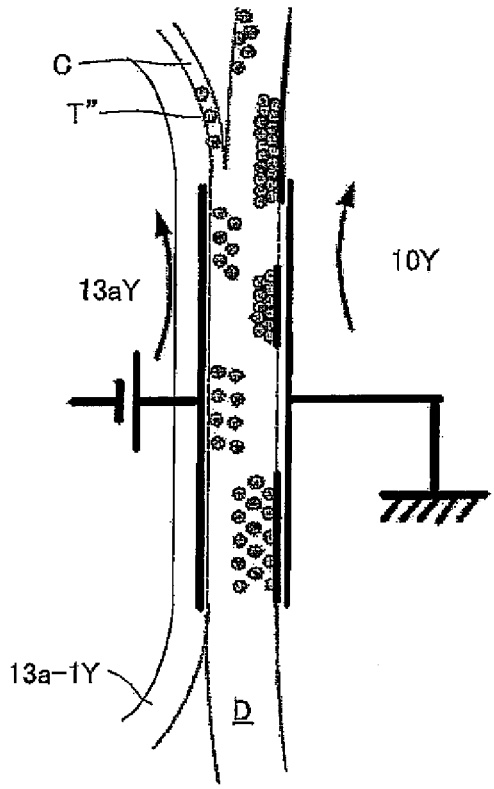
FIG. 6 is a schematic illustration of the squeezing effect of first image carrier squeezing roller 13*a*Y of the first example.
Figure 7:
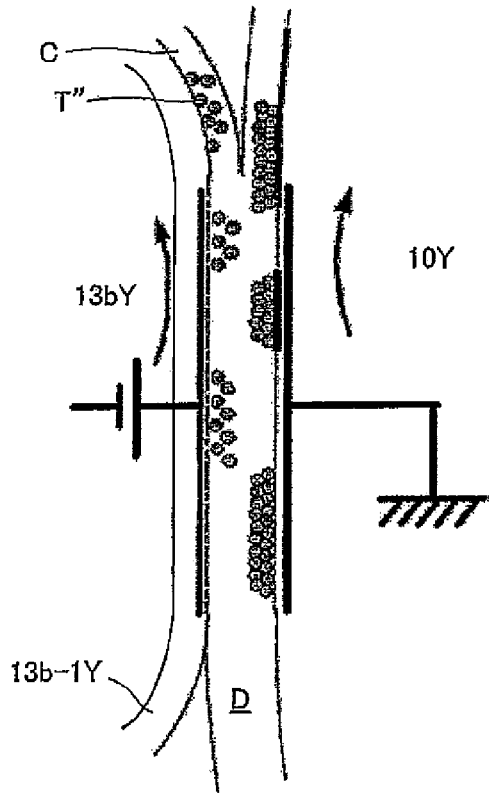
FIG. 7 is a schematic illustration of the squeezing effect of second image carrier squeezing roller 13*b*Y of the first example.
Figure 8:
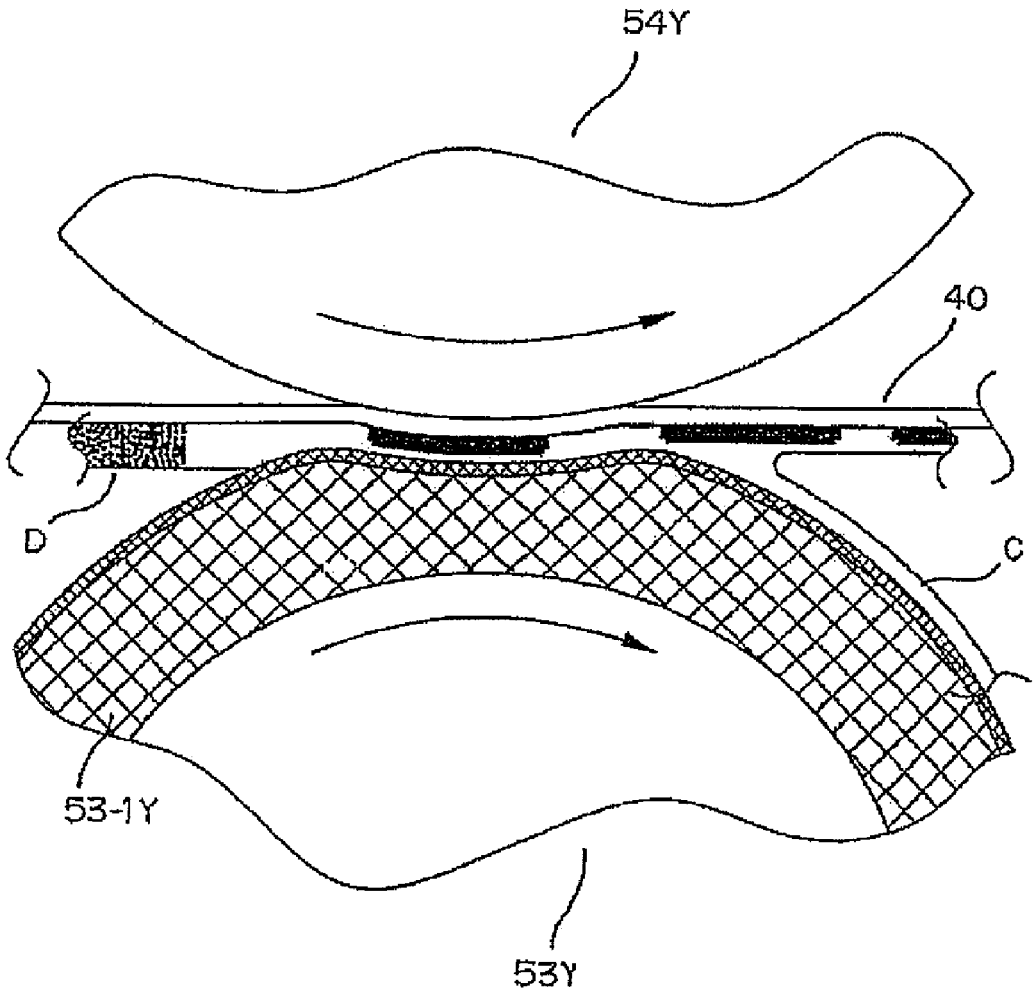
FIG. 8 is a schematic illustration of the squeezing effect of intermediate transfer member squeezing unit 52Y of the first example.

Now, the image forming sections and the development units will be described below. FIG. 2 is a schematic cross-sectional view of an image forming section and a development unit of the first example of the first embodiment, showing principal components thereof. FIG. 3 is a schematic perspective view of a developer supply member of the first embodiment. FIG. 4 is a schematic illustration of compaction of developer by the developer compaction unit 22Y of the first example. FIG. 5 is a schematic illustration of development by development roller 20Y of the first example. FIG. 6 is a schematic illustration of the squeezing effect of the first image carrier squeezing roller 13*a*Y of the first example. FIG. 7 is a schematic illustration of the squeezing effect of the second image carrier squeezing roller 13*b*Y of the first example. FIG. 8 is a schematic illustration of the squeezing effect of the intermediate transfer member squeezing unit 52Y of the first example. Since the image forming sections of different colors respectively have the same configuration and the configurations of the development units are similar to one another, the image forming section and the development unit of Y (yellow) will be described below.

In the image forming section, a charge eliminator unit 16Y, a cleaning unit including an image carrier cleaning blade 17Y and a developer collection section 18Y, a charger 11Y, an exposure unit 12Y, a development roller 20Y belonging to the development unit 30Y and first and second image carrier squeezing units 113*a*Y, 113*b*Y including a first image carrier squeezing roller 13*a*Y, a first cleaning blade 14*a*Y, a second image carrier squeezing roller 13*b*Y, a second cleaning blade 14*b*Y and a developer collection section 15Y are arranged along the outer periphery of the image carrier 10Y in the mentioned order as viewed in the sense of rotation thereof.

In the development unit 30Y, a cleaning blade 21Y and an developer supply roller 32Y, which is an anilox roller, are arranged around the outer periphery of the development roller 20Y and a liquid developer agitation paddle 34Y and a developer supply roller 32Y are contained in the liquid developer container 31Y. A developer collection section 25Y is arranged corresponding to the cleaning blade 21Y and the pipe of a first developer collection channel 81Y is connected to the developer collection section 15Y and the developer collection section 25Y for the purpose of recycling liquid developer.

Additionally, the primary transfer roller 51Y of the primary transfer section is arranged at a position located vis-a-vis the image carrier 10Y along the intermediate transfer member 40 and the intermediate transfer member squeezing unit 52Y is arranged at the downstream side of the primary transfer roller 51Y in the sense of the moving direction of the intermediate transfer member 40. The intermediate transfer member squeezing unit 52Y includes an intermediate transfer member squeezing roller 53Y, a backup roller 54Y, an intermediate transfer member squeezing roller cleaning blade 55Y, a developer collection section 56Y.

The image carrier 10Y is a photosensitive drum that is a cylindrical member having a width, which is broader than the width about 320 mm of the development roller 20Y, and a photosensitive layer is formed on the outer peripheral surface of the cylindrical member. It may rotate clockwise as shown in FIG. 2. The photosensitive layer of the image carrier 10Y is typically formed by using an organic image carrier or an amorphous silicon image carrier. The charger 11Y is arranged at the upstream side relative to the nip section of the image carrier 10Y and the development roller 20Y in the sense of rotation of the image carrier 10Y and a bias showing a polarity same as the polarity of the electric charge of image developing toper particles is applied from a power source (not shown) to electrically charge the image carrier 10Y. The exposure unit 12Y is arranged at the downstream side relative to the charger 11Y in the sense of rotation of the image carrier 10Y to expose the electrically charged surface of the image carrier 10Y to light and form a latent image on the image carrier 10Y.

The development unit 30Y includes a developer container 31Y storing a liquid developer in which toner is dispersed in carrier liquid to a weight ratio of about 25%, a development roller 20Y bearing the liquid developer and a developer supply roller 32Y, a limiting blade 33Y and an agitation paddle 34Y for agitating the liquid developer to maintain the uniformly dispersed state and supplying it to the development roller 20Y, a development roller cleaning blade 21Y for cleaning the development roller 20Y and a developer compaction unit 22Y for holding the liquid developer borne on the development roller 20Y in a compacted state.

The liquid developer contained in the developer container 31Y is not a popular volatile low concentration (about 1 to 2 wt %) and low viscosity liquid developer that is volatile at room temperature and prepared by using Isopar (trademark, available from Exxon) as carrier liquid but a non-volatile high concentration and high viscosity liquid developer that is not volatile at room temperature. More specifically, the liquid developer that is employed for the purpose of the present invention is a high viscosity (about 30 to 1,000 mPa·s) liquid developer prepared by adding solid particles of an average particle size of 1 μm, which are formed by dispersing a coloring agent such as a pigment in thermoplastic resin, in a liquid solvent such as an organic solvent, silicon oil, mineral oil or edible oil with a dispersing agent to make the toner solid concentration equal to about 25%.

The developer supply roller 32Y is a cylindrical member as shown in FIG. 3, which is an anilox roller having an undulated surface produced by uniformly forming fine helical grooves so as to make it easily bear a liquid developer. It is adapted to be driven to rotate typically counterclockwise as shown in FIG. 2. As for the dimensions of the grooves, they are arranged at a pitch of about 130 μm and with a depth of about 30 μm. The liquid developer is supplied from the developer container 31Y to the development roller 20Y by means of the developer supply roller 32Y. The agitation paddle 34Y and the developer supply roller 32Y may be held in sliding contact with each other or alternatively separated from each other.

The limiting blade 33Y is an elastic blade having an elastic member arranged on the surface thereof. More specifically, it includes a rubber section that is typically made of urethan rubber and is held in contact with the surface of the developer supply roller 32Y and a metal plate supporting the rubber section. It limits and adjusts the film thickness and the quantity of the liquid developer borne and conveyed by the developer supply roller 32Y, which is an anilox roller, and also adjusts the quantity of the liquid developer to be supplied to the development roller 20Y. Note that the developer supply roller 32Y may be driven to rotate not in the sense indicated by an arrow in FIG. 2 but in the opposite sense. Note, however, the limiting blade 33Y needs to be arranged at a position corresponding to the sense of rotation of the developer supply roller 32Y.

The development roller 20Y is an about 320 mm wide cylindrical member that is driven to rotate counterclockwise around the axis of rotation thereof as shown in FIG. 2. The development roller 20Y is formed by arranging an elastic layer typically made of polyurethane rubber, silicon rubber or NBR on the outer peripheral surface of an inner core, which is typically made of iron or some other metal. The development roller cleaning blade 21Y is typically made of rubber and held in contact with the surface of the development roller 20Y. It is arranged at the downstream side relative to the development nip section where the development roller 20Y is held in contact with the image carrier 10Y in the sense of rotation of the development roller 20Y so as to scrape off and remove the liquid developer remaining on the development roller 20Y. The scraped off liquid developer is recycled from the developer collection section 25Y by way of the piping of the first developer collection channel 81Y.

The developer compaction unit 22Y receives the corona discharge produced from the corona discharger. As shown in FIG. 4, the developer compaction unit 22Y drives the toner T that is uniformly dispersed in the carrier liquid C to move toward the development roller 20Y so as to make it cohesive and produce a so-called developer-compacted state T'. The compacted developer D borne by the development roller 20Y is developed corresponding to the latent image on the image carrier 10Y at the development nip section where the development roller 20Y is held in contact with the image carrier 10Y as shown in FIG. 5 as a predetermined electric field is applied to it. The residual developer D remaining on the development roller is scraped off and removed by the development roller cleaning blade 21Y and added to the developer in the developer container 31Y so as to be reused. Note that the carrier liquid and the toner added to the developer in the developer container 31Y are not in a mixed color state.

Now, the image carrier squeezing units 113*a*Y and 113*b*Y which operate as liquid developer collection units will be described below. The image carrier squeezing unit according to the present embodiment includes a first image carrier squeezing unit 113*a*Y, or a first squeezing section, and a second image carrier squeezing unit 113*b*Y, or a second squeezing section. They are constantly arranged vis-a-vis the image carrier 10Y at the downstream side relative to the development roller 20Y and constantly held in contact with the image carrier 10Y to collect the residual developer that is produced after the toner image on the image carrier 10Y is developed.

As shown in FIG. 6, the first image carrier squeezing unit 113*a*Y that operates as a first carrier liquid removal section includes a first image carrier squeezing roller 13*a*Y, which is an elastic roller member having a first elastic member 13*a*-1Y arranged on the surface of the first image carrier squeezing roller 13*a*Y and held in sliding contact with the image carrier 10Y so as to be driven to rotate, a first cleaning blade 14*a*Y pressed against and held in sliding contact with the first image carrier squeezing roller 13*a*Y to clean the surface thereof and a developer collection section 15Y as shown in FIG. 2.

As shown in FIG. 7, the second image carrier squeezing unit 113*b*Y that operates as a second carrier liquid removal section includes a second image carrier squeezing roller 13*b*Y which is an elastic roller member having a second elastic member 13*b*-1Y arranged on the surface of the second image carrier squeezing roller 13*b*Y and held in sliding contact with the image carrier 10Y so as to be driven to rotate and a second cleaning blade 14*b*Y pressed against and held in sliding contact with the second image carrier squeezing roller 13*b*Y to clean the surface thereof as shown in FIG. 2.

The image carrier squeezing units 113*a*Y and 113*b*Y have a function of collecting the surplus carrier liquid C and the unnecessary fogging toner T" from the developer D of the image developed on the image carrier 10Y to raise the toner particle content ratio in the developed visible image. A desired capacity of collecting the surplus carrier liquid C can be preset by appropriately defining the sense of rotation of the first image carrier squeezing roller 13*a*Y and the second image carrier squeezing roller 13*b*Y and the difference between the peripheral speed of the surface of the image carrier 10Y and the peripheral speed of the surface of the first image carrier squeezing roller 13*a*Y and the second image carrier squeezing roller 13*b*Y. The capacity of collecting the surplus carrier liquid C is raised when the first and second image carrier squeezing rollers are driven to rotate oppositely relative to the sense of rotation of the image carrier 10Y and also by selecting a large value for the difference of peripheral speed. A synergetic effect can be achieved by combining these effects.

The intermediate transfer member squeezing unit 52Y is arranged at the downstream side relative to the primary transfer section 50Y to remove the surplus carrier liquid C on the intermediate member 40 and raise the toner particle content ratio in the developed visible image. It is provided as means for removing the surplus carrier liquid C from the intermediate transfer member 40 when the toner weight ratio does not get to about 40% to 60% in a dispersed state of the liquid developer that is desired to make the secondary transfer function and the fixing function satisfactory in the final stage of operation where the carrier liquid in the developer (containing toner dispersed in a carrier) that is once transferred onto the intermediate transfer member 40 in the primary transfer section 50Y is further transferred onto a sheet member for a secondary transfer and then the image on the sheet member is fixed in the fixing process. Like the image carrier squeezing units, the intermediate transfer member squeezing unit 52Y includes an intermediate transfer member squeezing roller 53Y which is an elastic roller member having an elastic member arranged on the surface of the intermediate transfer member squeezing roller and held in sliding contact with the image carrier 10Y so as to be driven to rotate, a backup roller 54Y arranged vis-a-vis the intermediate transfer member squeezing roller 53Y with the image carrier 40 interposed between them, a cleaning blade 55Y pressed against and held in sliding contact with intermediate transfer member squeezing roller 53Y to clean the surface thereof and a developer collection section 56Y. As shown in FIG. 8, it has a function of collecting the surplus carrier C from the developer D transferred onto the intermediate transfer member 40 for a primary transfer. The developer collection section 56Y also operates as collection mechanism for receiving the carrier liquid collected by the magenta image carrier squeezing roller cleaning blade 14M arranged at the downstream side thereof.

A desired capacity of collecting the surplus carrier liquid C can be preset by appropriately defining the sense of rotation of the intermediate transfer member squeezing roller 53Y and the difference between the peripheral speed of the surface of the intermediate transfer member 40 and the peripheral speed of the surface of the intermediate transfer member squeezing roller 53Y. The capacity of collecting the surplus carrier liquid C is raised when the intermediate transfer member squeezing roller is driven to rotate oppositely relative to the sense of rotation of the intermediate transfer member 40 and also by selecting a large value for the different of peripheral speed. A synergetic effect can be achieved by combining these effects. In this embodiment, the intermediate transfer member squeezing roller 53Y is driven to rotate with the intermediate transfer member 40 substantially at a same peripheral speed so as to collect the surplus carrier to a weight ratio of about 5 to 10% from the developer transferred onto the intermediate transfer member 40 for a primary transfer in order to reduce the loads of rotary motion of both of them and suppress the effect of any external turbulence to the toner image on the intermediate transfer member 40.

While no mixed color phenomenon arises at the intermediate transfer member squeezing site of the first color because the first intermediate transfer member squeezing operation is executed there, the toner moved from the intermediate transfer member 40 to the intermediate transfer member squeezing roller 53Y involves color mixing because a toner image of a different color is laid on the toner image on the intermediate transfer member 40 at the site of transferring the image of the second color or a subsequently color for a primary transfer. The toner of mixed color is borne on the intermediate transfer member squeezing roller 53Y with the surplus carrier and collected from the intermediate transfer member squeezing roller 53Y by a cleaning blade so as to be pooled. Additionally, an intermediate transfer member squeezing unit is not required to be arranged at the downstream side relative to each of all the primary transfer strokes when the squeezing capacity of the image carrier 40 at the primary transfer site located upstream relative to the above-described intermediate transfer member squeezing stroke and the squeezing capacity of the image carrier squeezing roller 53Y are sufficiently large.

Now, the operation of an image forming apparatus according to the present invention will be described. Note that only the yellow image forming section and the yellow development unit 30Y of the apparatus will be described as examples out of the four image forming sections and the four development units.

In the developer container 31Y, the toner particles in the liquid developer have a positive electric charge. The liquid developer is agitated by the agitation paddle 34Y and sucked up from the developer container 31Y as the developer supply roller 32Y is driven to rotate.

The limiting blade 33Y is held in contact with the surface of the developer supply roller 32Y and scrapes off the surplus liquid developer from the surface of the developer supply roller 32Y, leaving only the liquid developer in the grooves of the undulations of the anilox pattern formed on the surface of the developer supply roller 32Y so as to limit the quantity of liquid developer supplied to the development roller 20Y. As a result of the liming operation, the film thickness of the liquid developer that is applied to the surface of the development roller 20Y is quantitatively defined so as to be about 6 μm. The liquid developer that is scraped off by the limiting blade 33Y is made to fall free and returned into the developer container 31Y, whereas the liquid developer that is not scraped off by the limiting blade 33Y is held in the grooves of the undulations on the surface of the developer supply roller 32Y and applied onto the surface of the development roller 20Y as the developer supply roller 32Y is pressed against the development roller 20Y.

The development roller 20Y, onto the surface of which the liquid developer is applied by the developer supply roller 32Y, is arranged vis-a-vis the developer compaction unit 22Y at a position downstream relative to the nip section of the development roller 20Y and the developer supply roller 32Y. A bias of about +400V is applied to the development roller 20Y, while a bias higher than that of the development roller 20Y and showing a polarity same as that of the electric charge of the toner is applied to the developer compaction unit 22Y. For instance, a bias of about +600V is applied to the developer compaction unit 22Y. As a result, the toner particles in the liquid developer on the development roller 20Y are moved to the side of the development roller 20Y when they pass the position where the developer compaction unit 22Y and the development roller 20Y are disposed face to face. Thus, the toner particles are brought into a condition where they are mildly bonded to each other to form a film so that the toner particles can move very quickly from the development roller 20Y to the image carrier 10Y at the time of development at the image carrier 10Y to consequently raise the concentration of toner particles in the formed image.

The image carrier 10Y is made of amorphous silicon and its surface is electrically charged to about +600 V by the charger 11Y at a position upstream relative to the nip section of the image carrier 10Y and the development roller 20Y before the electric potential of the image area is made to fall to +25 V by the exposure unit 12Y to form a latent image. At the development nip section that is formed between the development roller 20Y and the image carrier 10Y, the toner particles T are moved selectively onto the image area on the image carrier 10Y according to the electric field formed by the bias of +400 V being applied to the development roller 20Y and the latent image (+25 V in the image area and +600V in the non-image area) on the image carrier 10Y as shown in FIG. 5. Thus, as a result, a toner image is formed on the image carrier 10Y. Since the carrier liquid C is not influenced by the electric field, it is divided at the outlet of the development nip section of the development roller 20Y and the image carrier 10Y and adheres to both the development roller 20Y and the image carrier 10Y as shown in FIG. 5.

After passing the nip section, the image carrier 10Y passes the image carrier squeezing roller section 13Y. Both the first image carrier squeezing roller 13*a*Y and the second image carrier squeezing roller 13*b*Y have a function of collecting the surplus carrier liquid C and the unnecessary fogging toner T" from the developer D on the developed image on the image carrier 10Y as shown in FIGS. 6 and 7 to raise the toner particle ratio in the developed visible image.

The surplus carrier liquid C and the unnecessary fogging toner T" that are collected by the first image carrier squeezing roller 13*a*Y are then collected from the first image carrier squeezing roller 13*a*Y into the developer collection section 15Y under the effect of the first cleaning blade 14*a*Y and the surplus carrier liquid C and the unnecessary fogging toner T" that are collected by the second image carrier squeezing roller 13*b*Y are then collected from the second image carrier squeezing roller 13*b*Y into the developer collection unit 15Y under the effect of the second cleaning blade 14*b*Y. Then, they are recycled by way of the piping of the first developer collection channel 81Y. Note that mixed color phenomena do not arise at the all locations because the collected surplus carrier liquid C and the unnecessary fogging toner T" are collected from the dedicated and isolated image carrier 10Y.

Then, the image carrier 10Y passes the nip section between itself and the intermediate transfer member 40 in the primary transfer section 50Y so that the visible toner image on the image carrier 10Y is transferred onto the intermediate transfer member 40 for a primary transfer. A bias of about −200V showing a polarity opposite to that of the toner particles is applied to the primary transfer roller 51Y so that the toner on the image carrier 10Y is transferred onto the intermediate transfer member 40 for a primary transfer and only the carrier liquid is left on the image carrier 10Y. After the primary transfer, the electrostatic latent image on the image carrier 10Y is erased by the charge eliminator unit 16Y, which is typically formed by using LEDs, at a position downstream relative to the primary transfer section in the sense of rotation of the image carrier 10Y. The carrier liquid left on the image carrier 10Y is scraped off by the image carrier cleaning blade 17Y and collected by the developer collection section 18Y.

The toner image on the intermediate transfer member 40 that is formed by sequentially laying the toner images formed on the plurality of image carriers 10Y one on the other by primary transfers then proceeds to the secondary transfer unit 60 and gets into the nip section of the intermediate transfer member 40 and the first secondary transfer roller 61*a* and then into the nip section of the intermediate transfer member 40 and the second secondary transfer roller 61*b*. In the secondary transfer unit 60, −1,200 V is applied to both the first secondary transfer roller 61*a* and the second secondary transfer roller 61*b* and +200 V is applied to the belt drive roller 41. As a result, the toner image on the intermediate transfer member 40 is transferred onto a recording medium (sheet member) typically made of paper.

However, when a trouble occurs in supplying sheet members such as a jam, all the toner image is not transferred onto and received by the secondary transfer roller but partly left on the intermediate transfer member. Furthermore, when the secondary transfer process is proceeding normally, the toner image on the intermediate transfer member is not transferred onto a sheet member by 100% by a secondary transfer but left by several % as secondary transfer residue. Particularly, when a trouble occurs in supplying sheet members such as a jam, the toner image is brought into contact with and transferred onto the first secondary transfer roller 61*a* and the second secondary transfer roller 61*b* to consequently smear the rear surfaces of the sheet members that come after the trouble is dissolved. In this embodiment, a bias that urges the toner particles in the liquid developer toward the intermediate transfer member, or a bias showing a polarity same as the polarity of the electric charges of the toner particles, is applied to the first secondary transfer roller 61*a* and the second secondary transfer roller 61*b* while no transfer process is going on. As a result, the toner particles in the liquid developer left on the intermediate transfer member 40 are urged toward the intermediate transfer member 40 and put into a compacted condition and, at the same time, the carrier liquid is collected (squeezed) at the side of the first secondary transfer roller 61*a* and the second secondary transfer roller 61*b*. Then, the surface of the intermediate transfer member 40 is cleaned by the intermediate transfer member cleaning blade 46, while the first secondary transfer roller 61*a* and the second secondary transfer roller 61*b* are cleaned respectively by the first secondary transfer roller cleaning blade 62*a* and the second secondary transfer roller cleaning blade 62*b*.

Now, the squeezing function of the first secondary transfer roller 61*a* and the second secondary transfer roller 61*b* will be described below. A sheet member is supplied to the secondary transfer site at the timing when the toner image formed by laying toner images of different colors one on the other on the intermediate transfer member 40 gets to the secondary transfer site and the toner image is transferred onto the sheet member for a secondary transfer, which sheet member is then moved to the site of a fixing process (not shown) to ultimately complete the image forming operation. However, when a trouble occurs in supplying sheet members such as a jam, the toner image is brought into contact with and transferred onto the first secondary transfer roller 61*a* and the second secondary transfer roller 61*b* to consequently smear the rear surfaces of the sheet members that come after the trouble is dissolved. Note that, in this embodiment, an elastic belt is employed for the intermediate transfer member 40 to bear a plurality of toner images formed on a plurality of photosensitive members and transferred onto it sequentially one after another for primary transfers and subsequently transferring them collectively onto a sheet member for secondary transfers, following the surface of the sheet member, if the surface of the sheet member is fibrous and not smooth. Similarly, each of the first secondary transfer roller 61*a* and the second secondary transfer roller 61*b* is formed by using an elastic roller having an elastic member arranged on the surface thereof for the same purpose. The first secondary transfer roller cleaning blade 62*a* and the second secondary transfer roller cleaning blade 62*b* are provided as means for removing the developer (toner dispersed in carrier liquid) transferred onto the first secondary transfer roller 61*a* and the second secondary transfer roller 61*b* and the developer collected from the first secondary transfer roller 61*a* and the second secondary transfer roller 61*b* is pooled. Note that the pooled developer is in a mixed color state and may contain foreign objects such as paper powder.

Now, the cleaning unit of the intermediate transfer member 40 will be described below. When a trouble occurs in supplying sheet members such as a jam, all the toner image is not transferred onto and received by the first secondary transfer roller 61*a* and the second secondary transfer roller 61*b* but partly left on the intermediate transfer member 40. Furthermore, when the secondary transfer process is proceeding normally, the toner image on the intermediate transfer member 40 is not transferred onto a sheet member by 100% by a secondary transfer but left by several % as secondary transfer residue. Unnecessary toner images of these two types are collected by the intermediate transfer member cleaning blade 46 arranged so as to be held in contact with the intermediate transfer member 40 for the next image operation and the developer collection section 47. A bias that urges the toner particles in the residual toner on the intermediate transfer member 40 toward the intermediate transfer member 40 is applied to the first secondary transfer roller 61*a* and the second secondary transfer roller 61*b* while no transfer process is going on.

Now, the positional relationship between the first image carrier squeezing unit and the second image carrier squeezing unit in this embodiment where a plurality of squeezing rollers are arranged will be described below.

In this embodiment, the liquid developer collected by the second image carrier squeezing unit and containing carrier liquid to a large extent is moved to the first image carrier squeezing unit and collected by the collection section 15Y along with the liquid developer collected by the first image carrier squeezing unit.

With this arrangement, the liquid developer containing carrier liquid to a high ratio that is collected by the second image carrier squeezing unit is collected together with the liquid developer collected by the first image carrier squeezing unit and containing toner particles to a large extent to show a poor fluidity so that consequently the fluidity of the liquid developer collected by the first image carrier squeezing unit is raised to improve the collection efficiency.

More specifically, as shown in FIG. 2, the second cleaning blade 14*b*Y is arranged above the first cleaning blade 14*a*Y and the liquid developer containing carrier liquid to a high ratio that is collected by the second cleaning blade 14Y is made to fall free onto the first cleaning blade 14*a*Y from above.

With this arrangement, the liquid developer containing carrier liquid to a high ratio that is collected by the second cleaning blade 14*b*Y is collected together with the liquid developer collected by the first cleaning blade 14*a*Y and showing a poor fluidity so that consequently the fluidity of the liquid developer collected by the first cleaning blade 14*a*Y is raised to improve the collection efficiency.

Figure 9:
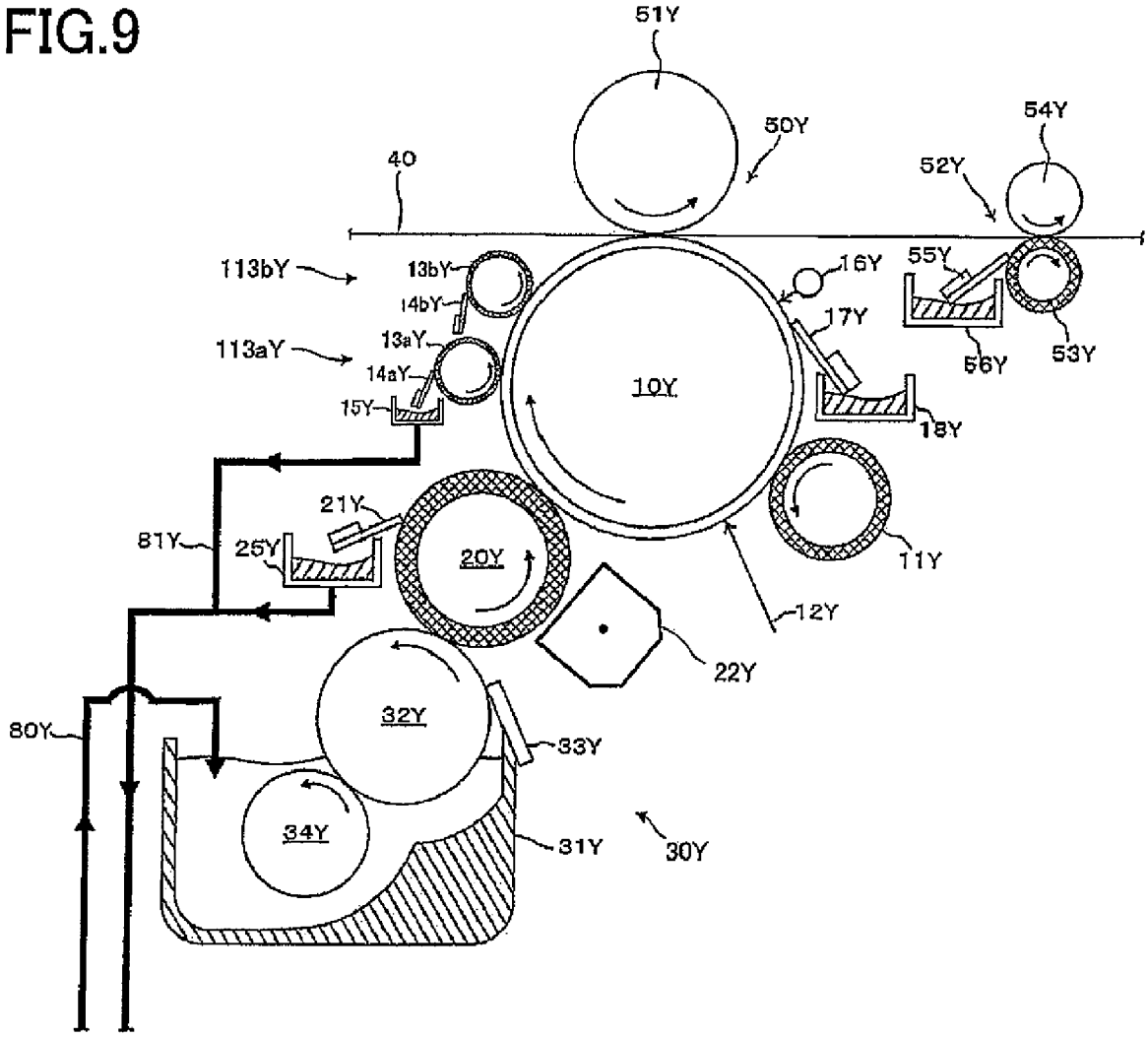
FIG. 9 is a schematic cross-sectional view of an image forming section and a development unit of the second example of the first embodiment, showing principal components thereof.

Now, referring to FIG. 9 showing the second example, the second cleaning blade 14*b*Y is arranged above the first image carrier squeezing roller 13*a*Y and the liquid developer containing carrier liquid to a high ratio that is collected by the second cleaning blade 14*b*Y is made to move or fall onto the first image carrier squeezing roller 13*a*Y from above.

With this arrangement, the liquid developer containing carrier liquid to a high ratio that is collected by the second cleaning blade 14*b*Y is collected together with the liquid developer collected by the first image carrier squeezing roller 13*a*Y and showing a poor fluidity so that consequently the fluidity of the liquid developer collected by the first image carrier squeezing roller 13*a*Y is raised to improve the collection efficiency.

Now, the position relationship between the first image carrier squeezing unit 113*a*Y and the second image carrier squeezing unit 113*b*Y of the first and second examples will be described below.

Figure 10:
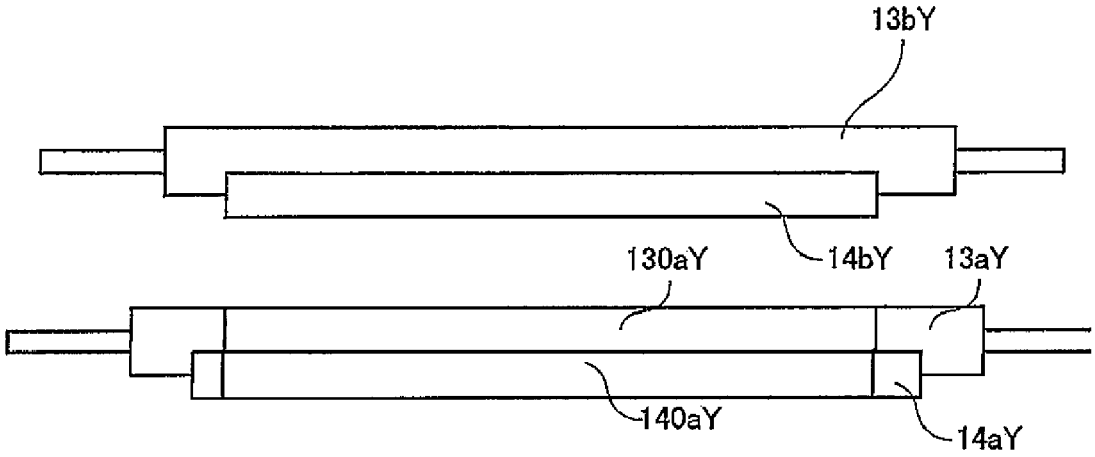
FIG. 10 is a schematic plan view of first image carrier squeezing unit and second image carrier squeezing unit of the second example.

FIG. 10 is a schematic plan view of the first image carrier squeezing unit 113*a*Y and the second image carrier squeezing unit 113*b*Y of the second example. As shown in FIG. 10, in this embodiment, the length of the first cleaning blade 14*a*Y in the axial direction of the image carrier is made greater than the length of the second cleaning blade 14*b*Y.

With this arrangement, when the liquid developer collected by the second cleaning blade 14*b*Y falls from the second cleaning blade 14*b*Y, it advantageously falls within the width 130*a*Y of the first image carrier squeezing roller 13*a*Y, or the width 140*a*Y of the first cleaning blade 14*a*Y, in the axial direction of the image carrier.

Figure 11:
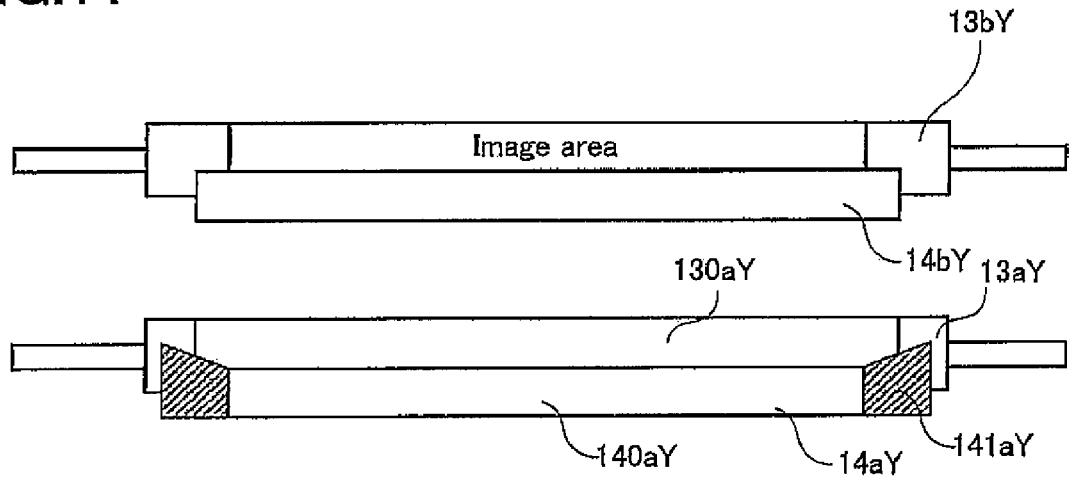
FIG. 11 is a schematic plan view of first image carrier squeezing unit and second image carrier squeezing unit of another example of the first embodiment.

FIG. 11 is a schematic plan view of the first image carrier squeezing unit 113*a*Y and the second image carrier squeezing unit 113*b*Y of another example, showing the position relationship between them. In this embodiment, the length of the first cleaning blade 14*a*Y is made smaller than the length of the second cleaning blade 14*b*Y in the axis direction of the image carrier and the first cleaning blade 14*a*Y is provided with gathering means 141*a*Y that gather the liquid developer falling at the opposite lateral sides in the axial direction of the image carrier toward the inside.

With this arrangement, as the liquid developer collected by the second cleaning blade 14*b*Y falls from the second cleaning blade 14*b*Y, it is advantageously collected within the width of the first cleaning blade 14*a*Y in the axial direction of the image carrier to eliminate the necessity of securing a broad non-image area.

Figure 12:
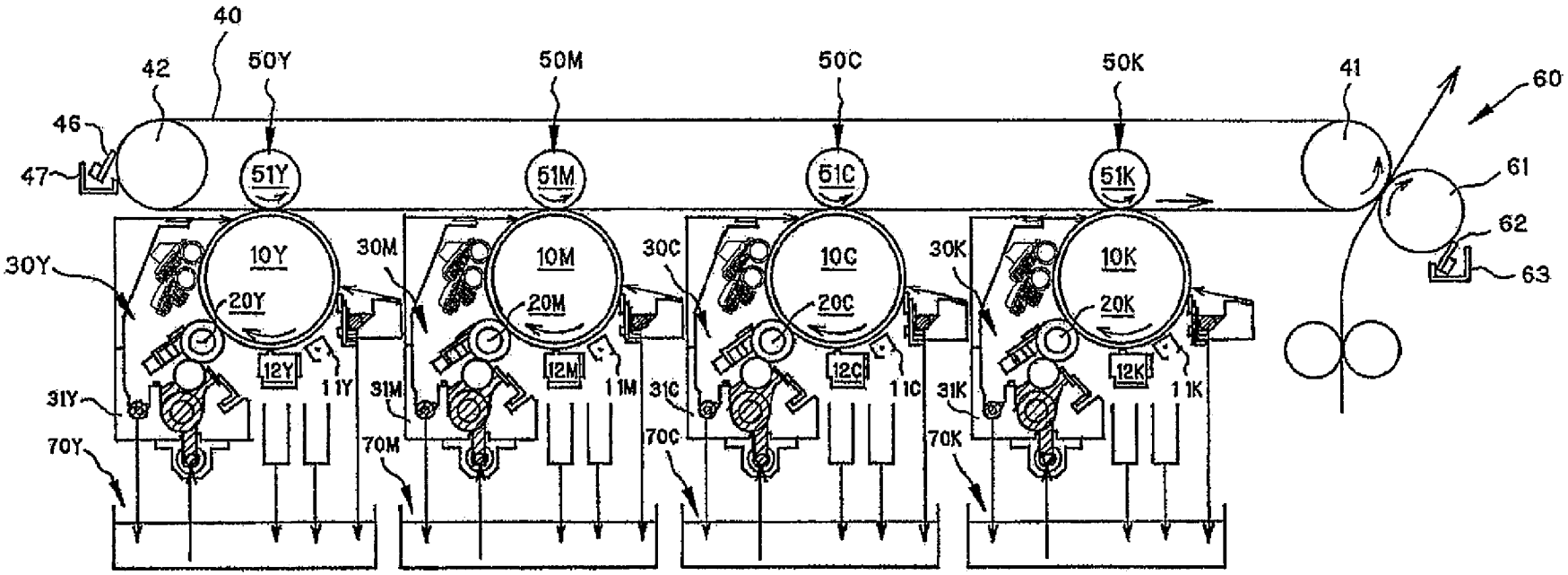
FIG. 12 is a schematic illustration of image forming apparatus according to a second embodiment of the present invention, showing principal components thereof.
Figure 13:
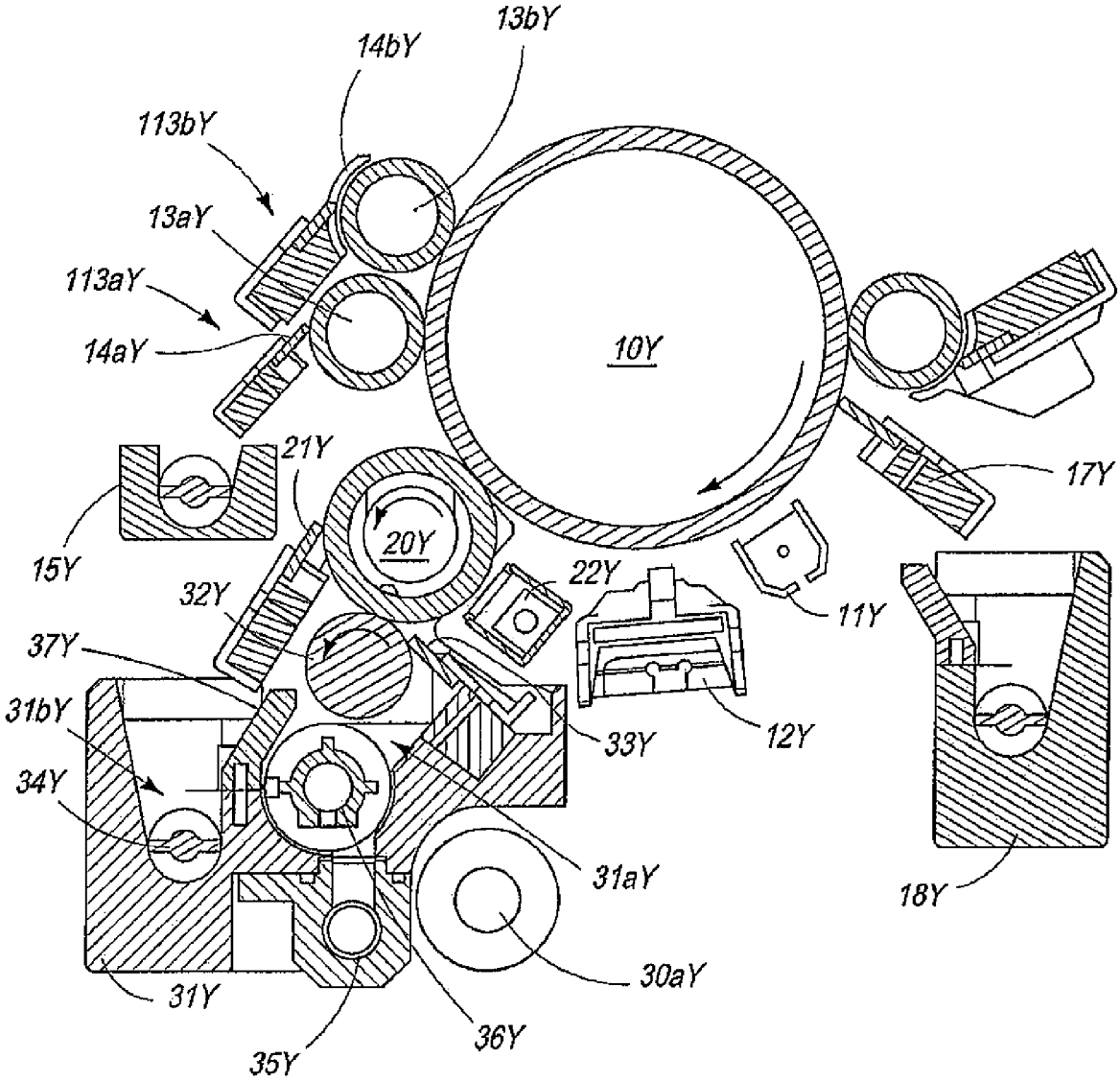
FIG. 13 is a schematic cross-sectional view of a latent image carrier, a peripheral area thereof and a development unit of the second embodiment, showing principal components thereof.

Now, the second embodiment of the present invention will be described below by referring to the related drawings. FIG. 12 is a schematic illustration of image forming apparatus according to the second embodiment of the present invention, showing principal components thereof and FIG. 13 is a schematic cross-sectional view of latent image carrier 10Y, a peripheral area thereof and development unit 30Y of the second embodiment, showing principal components thereof. The latent image carriers 10Y, 10M, 10C and 10K of the different colors of the second embodiment have the same configuration. Similarly, the development units 30Y, 30M, 30C and 30K of the different colors of the second embodiment have the same configuration. Therefore, only the latent image carrier 10Y, a peripheral area thereof and the development unit 30Y of yellow (Y) will be described below. The components of this embodiment that are the same as those of the first embodiment will not be described below repeatedly.

The developer container 31Y of this embodiment will be described below. The developer container 31Y includes a supply section 31*a*Y and a collection section 31*b*Y. The supply section 31*a*Y by turn includes an agitation auger 36Y that is an agitation member for agitating the developer in the developer container 31Y and a communication section 35Y for supplying liquid developer from liquid developer reservoir section 70Y to the agitation auger 36Y. The collection section 31*b*Y by turn includes a collection auger 34Y that is a conveyance member having a spiral blade for conveying the liquid developer scraped off by the development roller cleaning blade 21Y in the first direction directed toward behind FIG. 13 and feeding it to the liquid developer reservoir section 70Y among others.

As shown in FIG. 13, the liquid developer collected by the second image carrier squeezing unit 113*b*Y is made to fall onto the first image carrier squeezing unit 113*a*Y in this embodiment.

Figure 14:
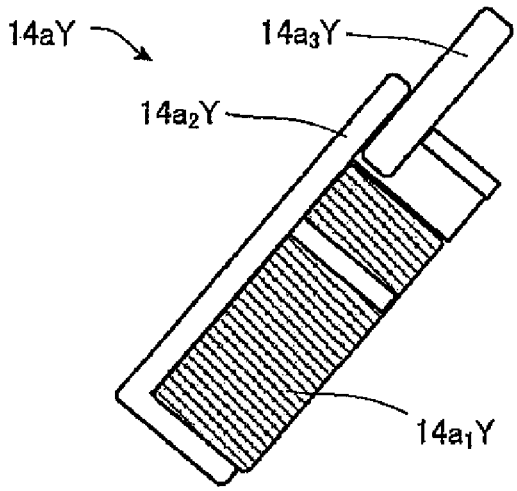
FIG. 14 is a schematic illustration of first cleaning blade 14*a*Y of the second embodiment, showing the structure thereof.

FIG. 14 is a schematic illustration of the first cleaning blade 14*a*Y, showing the structure thereof. The second cleaning blade 14*b*Y has a structure same as the first cleaning blade 14*a*Y and hence will not be described below.

The first cleaning blade 14*a*Y has a first metal plate holder 14$a_1$Y fitted to the main body side of the image forming apparatus including development cartridges, a first blade metal plate 14$a_2$Y that is a first plate support member supported by the first metal plate holder 14$a_1$Y and a first blade section 14$a_3$Y made of urethane and supported by the first blade metal plate 14$a_2$Y. The first blade metal plate 14$a_2$Y is arranged so as to partly cover the outer periphery of the first metal plate holder 14$a_1$Y. The first blade section 14$a_3$Y is bonded to the first blade metal plate 14$a_2$Y typically by means of a hot melt adhesive and hence the first blade section 14$a_3$Y and the first blade metal plate 14$a_2$Y are integrally combined and secured to the first metal plate holder 14$a_1$Y typically by means of screws.

Figure 15:
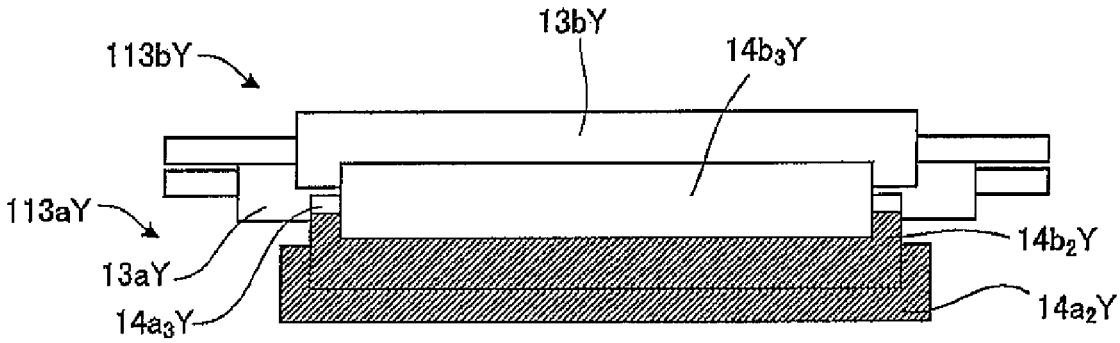
FIG. 15 is a schematic illustration of first image carrier squeezing unit and second image carrier squeezing unit, showing the positional relationship thereof.

FIG. 15 is a schematic illustration of the first image carrier squeezing unit 113*a*Y and the second image carrier squeezing unit 113*b*Y, showing the positional relationship thereof. As seen from FIGS. 13 and 15, the liquid developer that is scraped off from the second squeezing roller 13*b*Y by the second blade section 14$b_3$Y of the second cleaning blade 14*b*Y of the second image carrier squeezing unit 113*b*Y is put together with the liquid developer that is made to fall from the second blade metal plate 14$b_2$Y, which operates as the second blade support member, onto the first blade metal plate 14$a_2$Y of the first cleaning blade 14*a*Y and that is scraped off from the first squeezing roller 13*a*Y by the first blade section 14$a_3$Y and collected by the squeezed developer collection section 15 in this embodiment.

With the above-described arrangement, the liquid developer falls onto the first blade metal plate 14$a_2$Y, which is a metal-made member and which provides a better fluidity than the first blade section 14$a_3$Y, so that it advantageously flows easier if compared with an arrangement with which the liquid developer is made to fall onto the first blade section 14$a_3$Y that is made of rubber or resin.

Additionally, in this embodiment, the length of the first blade metal plate 14$a_2$Y in the axial direction of the image carrier is made greater than the length of the second blade metal plate 14$b_2$Y. With this arrangement, when the liquid developer collected by the second cleaning blade 14$b$Y falls from the second blade metal plate 14$b_2$Y, it falls within the width of the first blade metal plate 14$a_2$Y in the axial direction of the image carrier so that the leak of liquid developer in the axial direction of the image carrier is advantageously reduced.

Figure 16:
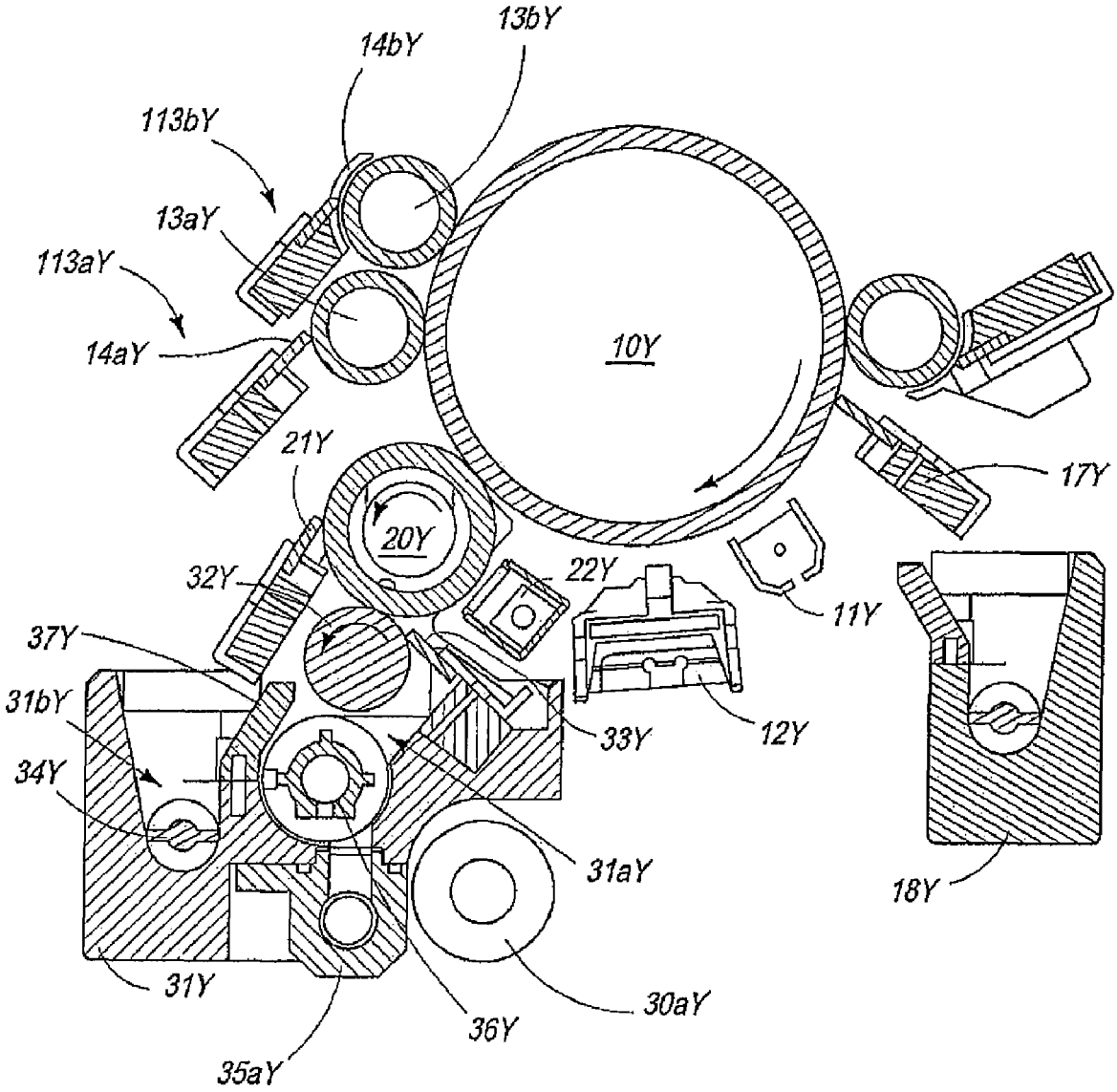
FIG. 16 is a schematic illustration according to a third embodiment of the present invention.

FIG. 16 is a schematic illustration according to a third embodiment of the present invention. In the third embodiment, without using the squeezed developer collection section 15, the liquid developer that falls from the first blade metal plate 14$a_2$Y of the first cleaning blade 14$a$Y is made to directly fall into the collection section 31$b$Y of the developer container 31Y. With this arrangement, the number of parts of the embodiment is reduced to by turn reduce the manufacturing cost.

Figure 17:
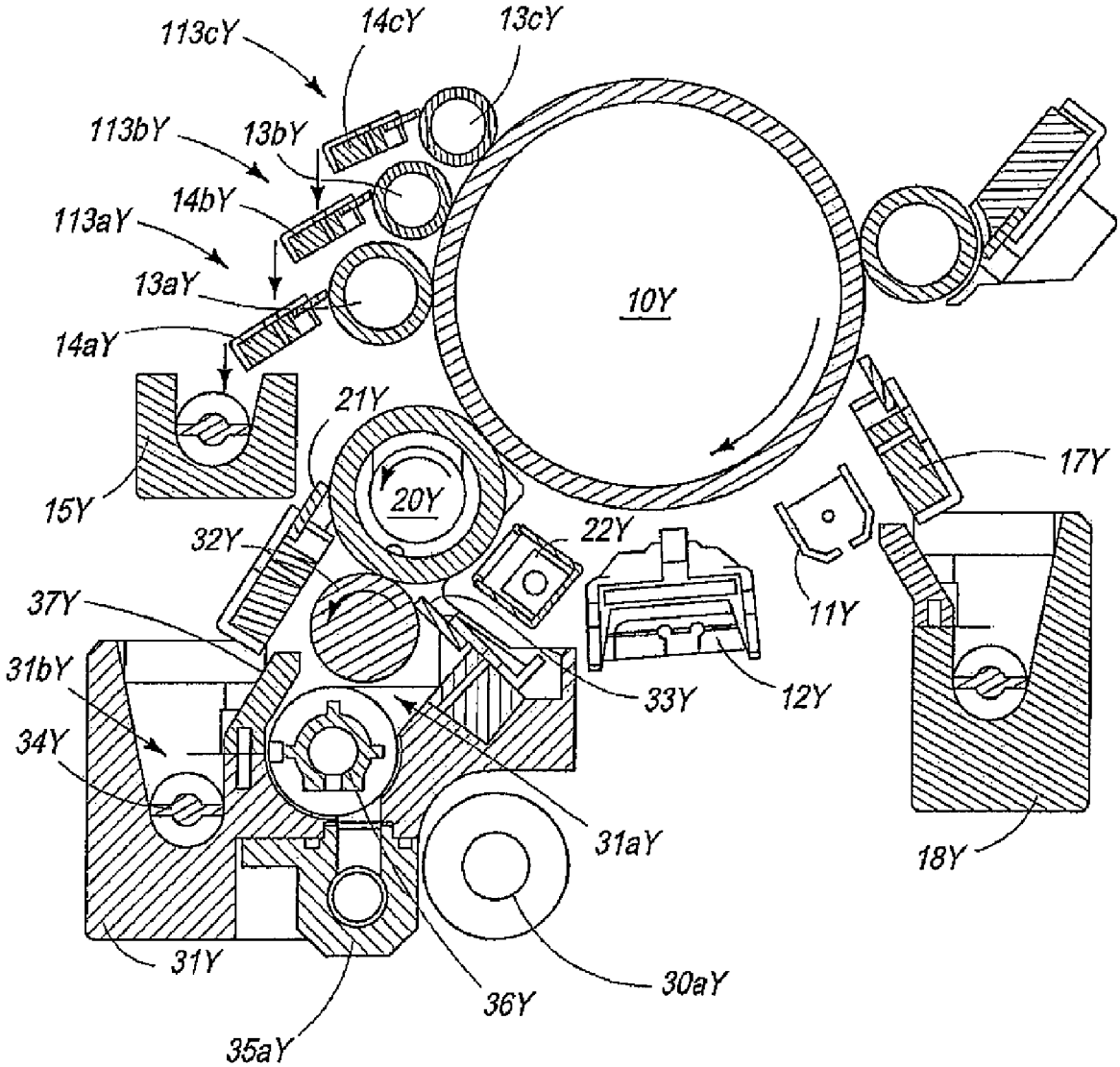
FIG. 17 is a schematic illustration according to a fourth embodiment of the present invention.

FIG. 17 is a schematic illustration according to a fourth embodiment of the present invention. The fourth embodiment has a third image carrier squeezing unit 113$c$Y, or a third squeezing section. The liquid developer collected by the third image carrier squeezing unit 113$c$Y is made to fall onto the second image carrier squeezing unit 113$b$Y and the liquid developer collected by the second image carrier squeezing unit 113$b$Y is made to fall onto the first image carrier squeezing unit 113$a$Y. With this arrangement, the liquid developer can be squeezed very effectively.

Figure 18:
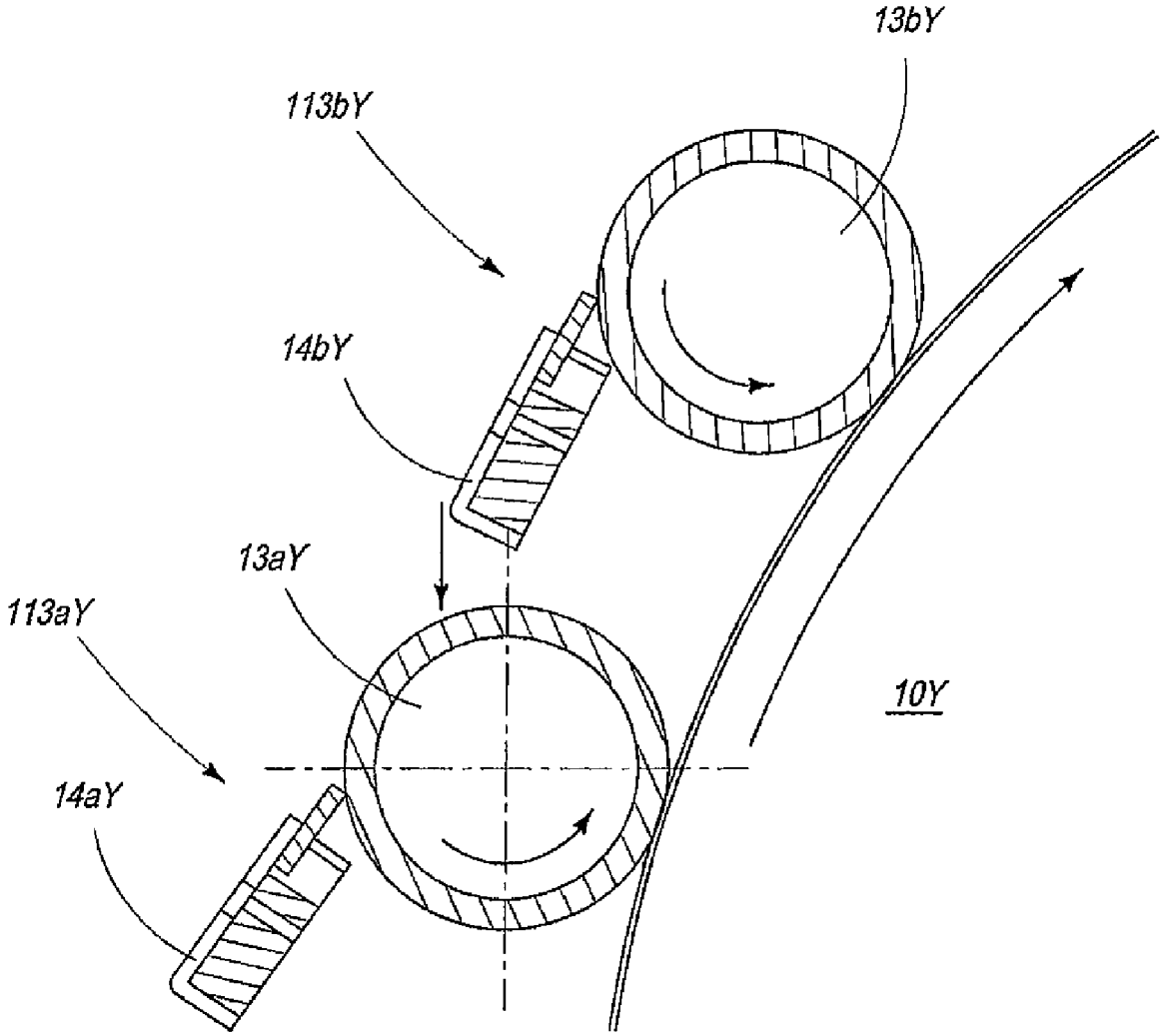
FIG. 18 is an enlarged schematic view of part of FIG. 9.

FIG. 18 is an enlarged schematic view of part of FIG. 9. It shows an arrangement obtained by improving the second example of the first embodiment.

In this example, as in the second example, the second cleaning blade 14$b$Y is arranged above the first image carrier squeezing roller 13$a$Y and the liquid developer containing carrier liquid to a high ratio that is collected by the second cleaning blade 14$b$Y is made to fall onto the first image carrier squeezing roller 13$a$Y from above.

The liquid developer scraped off from the second squeezing roller 13$b$Y by the second blade section 14$b_3$Y is made to fall from the second blade metal plate 14$b_2$Y onto the first image carrier squeezing roller 13$a$Y at a relatively higher position at the side of the first cleaning blade 14$a$Y.

With this arrangement, the liquid developer containing carrier liquid to a high ratio that is collected by the second cleaning blade 14$b$Y is collected along with the liquid developer showing a poor fluidity that is collected by the first image carrier squeezing roller 13$a$Y so that the fluidity of the liquid developer collected by the first image carrier squeezing roller 13$a$Y is raised to improve the collection efficiency. Additionally, when the first image carrier squeezing roller 13$a$Y is not rotating, the liquid developer on the first image carrier squeezing roller 13$a$Y is drawn downward by gravity so that it can fall down by way of the first blade section 14$a_3$Y and the first blade metal plate 14$a_2$Y of the first cleaning blade 14$a$Y.

The arrangement described above for the positional relationship between the first image carrier squeezing unit 113$a$Y and the second image carrier squeezing unit 113$b$Y of this embodiment is also applicable to the positional relationship between the second image carrier squeezing unit 113$b$Y and the third image carrier squeezing unit 113$c$Y illustrated in FIG. 17.

The first carrier liquid removal section 113$a$Y includes the first image carrier squeezing roller 13$a$Y and the first cleaning blade 14$a$Y that is held in contact with the first image carrier squeezing roller 13$a$Y and the second carrier liquid removal section 113$b$Y includes the second image carrier squeezing roller 13$b$Y and the second cleaning blade 14$b$Y that is held in contact with the second image carrier squeezing roller 13$b$Y. The liquid developer is collected effectively with this arrangement.

After the liquid developer collected by the second image carrier squeezing roller 13$b$Y is scraped off by the second cleaning blade 14$b$Y, the liquid developer scraped off by the second cleaning blade falls free onto the first cleaning blade 14$a$Y so that the fluidity of the liquid developer collected by the first cleaning blade 14$a$Y is raised to improve the collection efficiency.

The first cleaning blade 14$a$Y includes the first blade metal plate 14$a_2$Y that supports the first blade section 14$a_3$Y, whereas the second cleaning blade 14$b$Y includes the second blade metal plate 14$b_2$Y that supports the second blade section 14$b_3$Y and the liquid developer scraped off by the second blade section 14$b_3$Y is made to fall free from the second blade metal plate 14$b_2$Y onto the first blade metal plate 14$a_2$Y so that both the fluidity of the liquid developer collected by the first cleaning blade 14$a$Y and that of the liquid developer collected by the second blade section 14$b_3$Y are raised to further improve the collection efficiency.

Additionally, since the liquid developer collected by the second image carrier squeezing roller 13$b$Y is made to fall free from the second cleaning blade 14$b$Y onto the first image carrier squeezing roller 13$a$Y, the fluidity of the liquid developer collected by the first image carrier squeezing roller 13$a$Y is raised to improve the collection efficiency.

Still additionally, since the liquid developer that falls free from the second cleaning blade 14$b$Y onto the first image carrier squeezing roller 13$a$Y is made to fall free to the side of the first cleaning blade 14$a$Y relative to the virtual vertical line passing through the axis of rotation of the first image carrier squeezing roller 13$a$Y. With this arrangement, the falling liquid developer can move downward by free fall even when the first image carrier squeezing roller 13$a$Y is held at rest and hence not rotating so as to fall further below by way of the first blade section 14$a_3$Y and the first blade metal plate 14$a_2$Y of the first cleaning blade 14$a$Y.

Still additionally, since the length of the first cleaning blade 14$a$Y in the axial direction of the first image carrier squeezing roller 13$a$Y is greater than the length of the second cleaning blade 14$b$Y in the axial direction of the second image carrier squeezing roller 13$b$Y, when the liquid developer collected by the second cleaning blade 14$b$Y falls from the second cleaning blade 14$b$Y, it advantageously falls within the width of the first image carrier squeezing roller 13$a$Y or the first cleaning blade 14$a$Y in the axial direction of the image carrier 10Y.

Still additionally, the first cleaning blade 14$a$Y has gathering means 141$a$Y for that gather the liquid developer collected by the first image carrier squeezing roller 13$a$Y toward the center in the axis direction of the first image carrier squeezing roller 13$a$Y. Therefore, when the liquid developer collected by the second cleaning blade 14$b$Y falls from the second cleaning blade 14$b$Y, it is advantageously collected within the width of the first cleaning blade 14$a$Y in the axial direction of the image carrier 10Y to eliminate the necessity of securing a broad non-image area.

Still additionally, since the embodiment has the third carrier liquid removal section 113$c$Y arranged vertically above the second carrier liquid removal section 113$b$Y and squeezing the image squeezed by the second carrier liquid removal section 113$b$Y and the liquid developer collected by the third carrier liquid removal section 113$c$Y is made to fall free onto the second carrier liquid removal section 113$b$Y so as to be collected by the latter, the fluidity of the liquid developer collected by the second carrier liquid removal section 113$b$Y is raised to further improve the collection efficiency.

Still additionally, since the third carrier liquid removal section 113$c$Y has the third image carrier squeezing roller 13$c$Y and the third cleaning blade 14$c$Y held in contact with the third image carrier squeezing roller 13$c$Y, the liquid developer collection efficiency is improved.

Furthermore, since the liquid developer collected by the third image carrier squeezing roller 13$c$Y is scraped off by the third cleaning blade 14$c$Y and subsequently made to fall free onto the second cleaning blade 14$b$Y, the fluidity of the liquid developer collected by the second cleaning blade 14$b$Y is raised to improve the collection efficiency.

Furthermore, since the third cleaning blade 14$c$Y has the third blade metal plate 14$c_2$Y that operates as the third blade support member supporting the third blade section 14$c_3$Y and the liquid developer scraped off by the third blade section 14$c_3$Y is made to fall free from the third blade metal plat 14$c_2$Y onto the second blade metal plate 14$b_2$Y, both the fluidity of the liquid developer collected by the second cleaning blade 14$b$Y and that of the liquid developer collected by the third blade section 14$c_3$Y are raised to improve the collection efficiency.

Furthermore, since the third carrier liquid removal section 113$c$Y has the third image carrier squeezing roller 13$c$Y, and the third cleaning blade 14$c$Y held in contact with the third image carrier squeezing roller 13$c$Y and the liquid developer collected by the third image carrier squeezing roller 13$c$Y is made to fall from the third cleaning blade 14$c$Y onto the second image carrier squeezing roller 13$b$Y, the fluidity of the liquid developer collected by the second image carrier squeezing roller 13$b$Y is raised to improve the collection efficiency.

Besides, the liquid developer that falls free from the third cleaning blade 14$c$Y onto the second image carrier squeezing roller 13$b$Y is made to fall free to the side of the second cleaning blade 14$b$Y relative to the virtual vertical plane passing through the axis of rotation of the second image carrier squeezing roller 13$b$Y, the falling liquid developer can move downward by free fall even when the second image carrier squeezing roller 13$b$Y is held at rest and hence not rotating so as to fall further below by way of the second blade section 14$b_3$Y and the second support member 14$b_2$Y of the second cleaning blade 14$b$Y.

Finally, the image forming apparatus according to the present invention includes a developer carrier 20Y that carries a liquid developer containing carrier liquid and toner particles, a photosensitive member 10Y that bears an image developed by means of the developer carrier, a transfer member 40 onto which the image of the photosensitive member 10Y is transferred, a first carrier liquid removal unit 113$a$Y that squeezes off the liquid developer on the photosensitive member 10Y bearing the image developed by means of the developer carrier and a second carrier liquid removal unit 113$b$Y that is arranged vertically above the first carrier liquid removal unit 113$a$Y to squeeze the photosensitive member 10Y that is squeezed by the first carrier liquid removal unit 113$a$Y and the liquid developer collected by the second carrier liquid removal unit 113$b$Y is made to fall free onto the first carrier liquid removal unit 113$a$Y for collection. With this arrangement, images of an excellent quality can be formed by means of a liquid developer that shows a concentration of a stabilized level.

What is claimed is:

1. A liquid developer collection apparatus comprising:

a first squeezing section that squeezes an image developed by a liquid developer containing carrier liquid and toner particles and that collect a residual liquid developer on an image carrier;

a second squeezing section arranged vertically above the first squeezing section that squeezes the image squeezed by the first squeezing section, and that collects the residual liquid developer; and a developer collection section that collects the residual liquid developer by collecting by the first squeezing section and the second squeezing section, wherein the residual liquid developer collected by the second squeezing section being made to fall free onto the first squeezing section and being collected into the developer collection section along with the residual liquid developer collected by the first squeezing section.

2. The apparatus according to claim 1, wherein the first squeezing section includes a first image carrier squeezing roller and a first cleaning blade held in contact with the first image carrier squeezing roller, and the second squeezing section includes a second image carrier squeezing roller and a second cleaning blade held in contact with the second image carrier squeezing roller.

3. The apparatus according to claim 2, wherein the residual liquid developer collected by the second image carrier squeezing roller is scraped off by the second cleaning blade and subsequently the liquid developer scraped off by the second cleaning blade is made to fall free onto the first cleaning blade.

4. The apparatus according to claim 2, wherein the first squeezing section includes a first blade support member supporting the first cleaning blade, the second squeezing section includes a second blade support member supporting the second cleaning blade, and the residual liquid developer scraped off by the second cleaning blade is made to fall free from the second blade support member onto the first blade support member.

5. The apparatus according to claim 2, wherein the residual liquid developer collected by the second image carrier squeezing roller is made to fall free from the second cleaning blade onto the first image carrier squeezing roller.

6. The apparatus according to claim 5, wherein the residual liquid developer that falls free from the second cleaning blade onto the first image carrier squeezing roller is made to fall free to the side of the first cleaning blade relative to the virtual vertical line passing through the axis of rotation of the first image carrier squeezing roller.

7. The apparatus according to claim 2, wherein a length of the first cleaning blade in the axial direction of the first image carrier squeezing roller is greater than a length of the second cleaning blade in the axial direction of the second image carrier squeezing roller.

8. The apparatus according to claim 2, wherein the first cleaning blade has gathering means that gather the liquid developer collected by the first image carrier squeezing roller toward the center side of the first image carrier squeezing roller relative to the direction of the axis of rotation thereof.

9. The apparatus according to claim 1, further comprising:

a third squeezing section arranged vertically above the second squeezing section that squeezes the image squeezed by the second squeezing section, the residual liquid developer collected by the third squeezing section being made to fall free onto the second squeezing section and being collected into the developing collection section along with the residual liquid developer collected by the second squeezing section.

10. The apparatus according to claim 9, wherein the third squeezing section includes a third image carrier squeezing roller and a third cleaning blade held in contact with the third image carrier squeezing roller.

11. The apparatus according to claim 10, wherein the residual liquid developer collected by the third image carrier squeezing roller is scraped off by the second cleaning blade and subsequently is made to fall free onto the second cleaning blade.

12. The apparatus according to claim 11, wherein the third cleaning blade includes a third blade support member supporting the third cleaning blade, and the residual liquid developer scraped off by the third cleaning blade is made to fall free from the third blade support member onto the second blade support member.

13. The apparatus according to claim 10, wherein the residual liquid developer collected by the third image carrier squeezing roller is made to fall free from the third cleaning blade onto the second image carrier squeezing roller.

14. The apparatus according to claim 13, wherein the residual liquid developer that falls free from the third cleaning blade onto the second image carrier squeezing roller is made to fall free to the side of the second cleaning blade relative to the virtual vertical plane passing through the axis of rotation of the second image carrier squeezing roller.

15. An image forming apparatus comprising:

a development unit that includes an image carrier that carries an image developed by a developer carrier;

a first squeezing section that squeezes the image developed by the developer carrier that collects a residual liquid developer;

a second squeezing section arranged vertically above the first squeezing section that squeezes the image squeezed by the first squeezing section, and that collects the residual liquid developer;

a transfer member on which is received the image squeezed by the second squeezing section; and an image carrier cleaning blade that cleans the image carrier, wherein the residual liquid developer collected by the second squeezing section being made to fall free onto the first squeezing section and being collected into a collection section along with the residual liquid developer collected by the first squeezing section.

* * * * *